US008539735B2

(12) United States Patent
Belicofski

(10) Patent No.: US 8,539,735 B2
(45) Date of Patent: Sep. 24, 2013

(54) METHOD OF CONSTRUCTION USING A GEODESIC HONEYCOMB SKELETON

(76) Inventor: Jeffrey Max Belicofski, Sydney (AU)

( * ) Notice: Subject to any disclaimer, the term of this patent is extended or adjusted under 35 U.S.C. 154(b) by 0 days.

(21) Appl. No.: 13/317,277

(22) Filed: Oct. 14, 2011

(65) Prior Publication Data

US 2012/0060431 A1 Mar. 15, 2012

Related U.S. Application Data

(63) Continuation-in-part of application No. 12/215,369, filed on Jun. 25, 2008, now abandoned.

(51) Int. Cl.
*E04B 1/32* (2006.01)

(52) U.S. Cl.
USPC ..... 52/745.21; 52/81.1; 52/81.4; 52/81.5; 52/745.07

(58) Field of Classification Search
USPC ..... 52/81.1, 81.2, 81.4, 81.5, 81.6, DIG. 10, 52/745.07, 745.21
See application file for complete search history.

(56) References Cited

U.S. PATENT DOCUMENTS 4,509,500 A * 4/1985 Mori ..... 126/578
5,560,151 A * 10/1996 Roberts ..... 52/81.1
6,173,538 B1 * 1/2001 Fleishman ..... 52/81.4
7,316,197 B2 * 1/2008 Herrmann ..... 114/312
7,389,612 B1 * 6/2008 Fischbeck ..... 52/81.1
7,452,578 B2 * 11/2008 Lanahan ..... 428/36.1
2009/0113815 A1 * 5/2009 Woodcock ..... 52/81.1

OTHER PUBLICATIONS

"Geodesic Math and how to use it" pp. 36-40 by Hugh Kenner; published by Uni of California Press 1976; ISBN ; 0-520-029-24-0.
"Applied Statics and strengths of materials" pp. 263-297 by Leonard Spiegel and George Limburger—2nd Edit: 1995; ISBN ; 0-02-414961-6.

* cited by examiner

*Primary Examiner* — Brian Glessner
*Assistant Examiner* — Adam Barlow

(57) ABSTRACT

A method of construction by which the framework of various structures can be erected in a Geodesic manner is proposed. These structures are Geodesic in that they are comprised of a large number of a few identical parts and such that the pressure on the structure is distributed throughout the structure: In this case, the thicker the Dimensions of the parts the greater the strength of the structure. This method uses hollow hexagonal and hollow pentagonal pyramidal frustums fastened together as the main building blocks of the Geodesic structure. These structures mirror the molecular world of the Carbon-60 molecule, the strongest molecule known for it's size. Thus, this proposed method of construction would provide structural enclosures that are immensely strong; such a structural enclosure given a superior quality rating by this method would be immune from the destructive effects of Tornadoes, Hurricanes, and earthquakes.

1 Claim, 27 Drawing Sheets fig 5
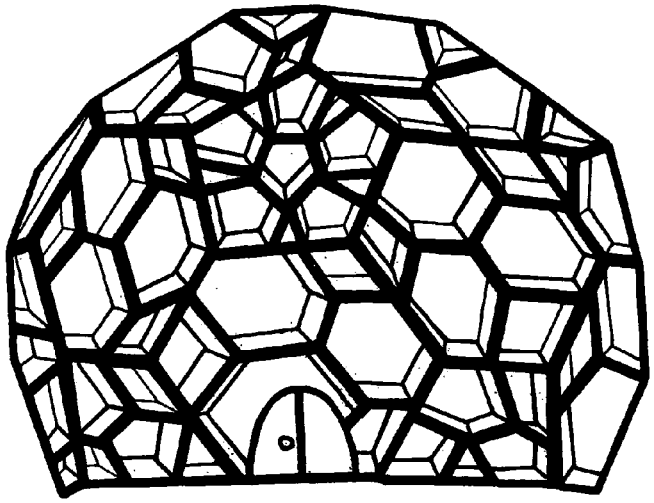
fig 6
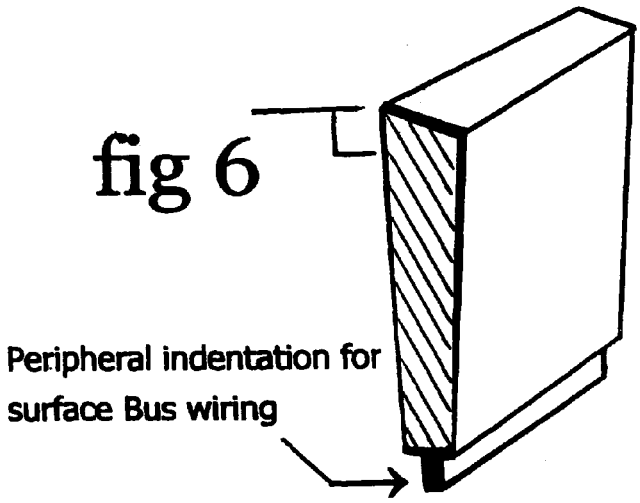
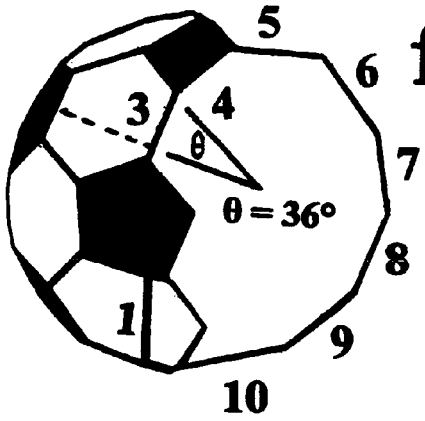
fig 7a
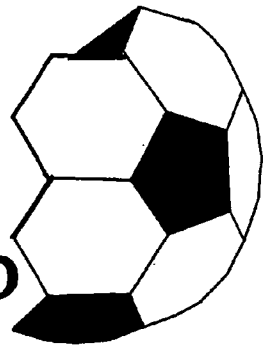
fig 7b fig 8
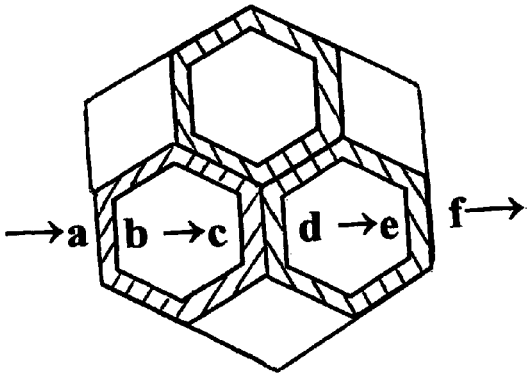
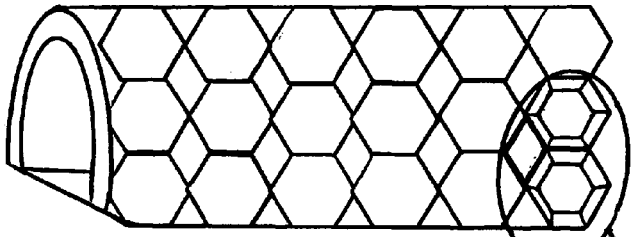
fig 9a
fig 9b
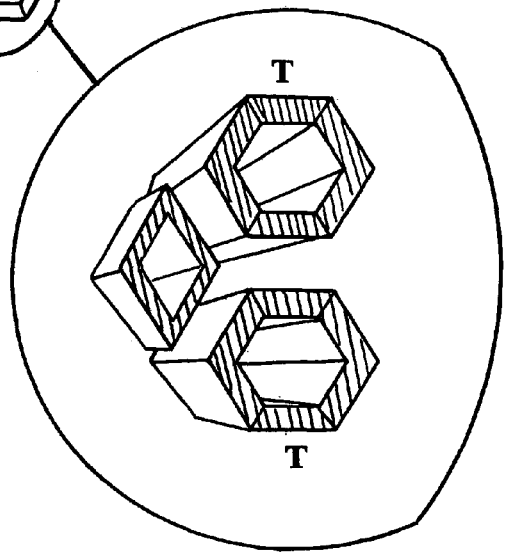
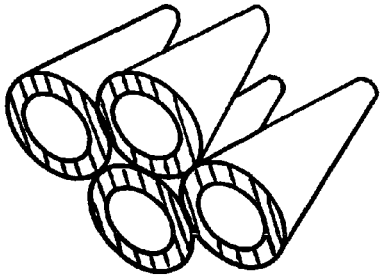
fig 10

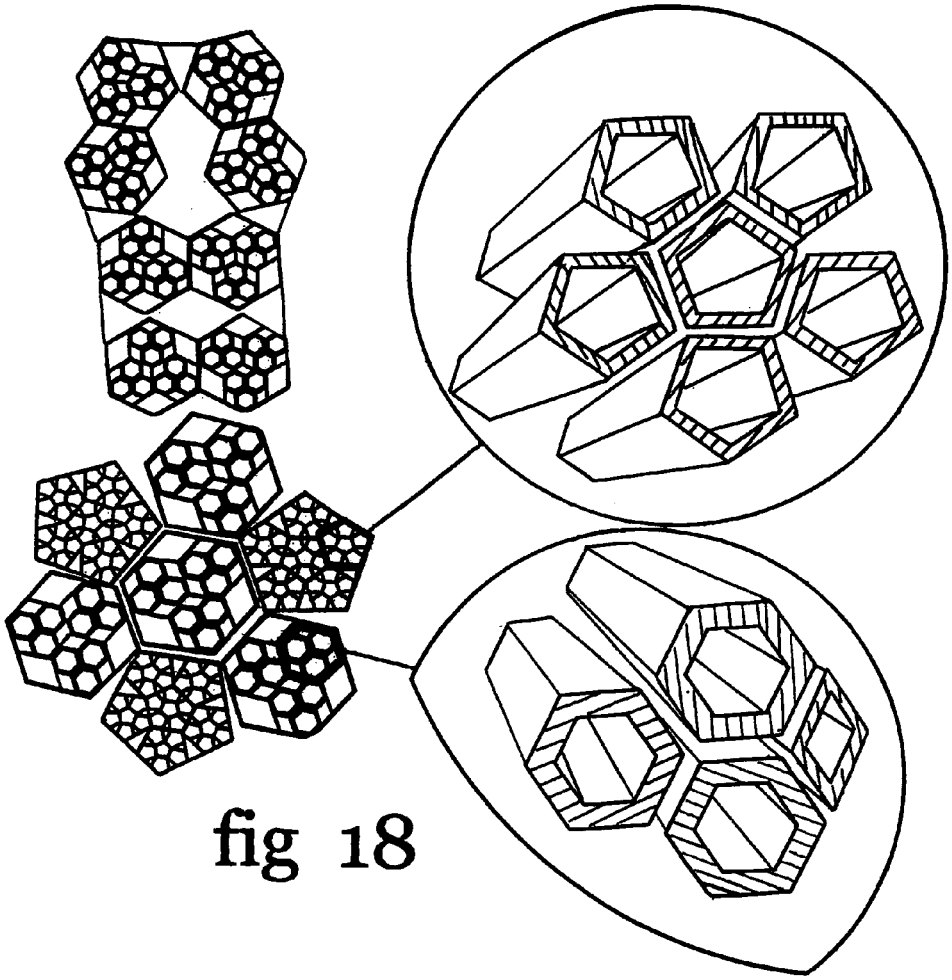
fig 18
fig 19
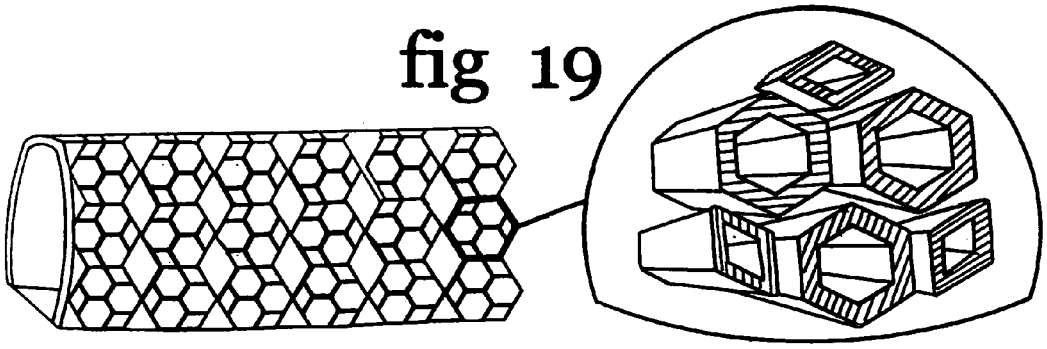

fig 20
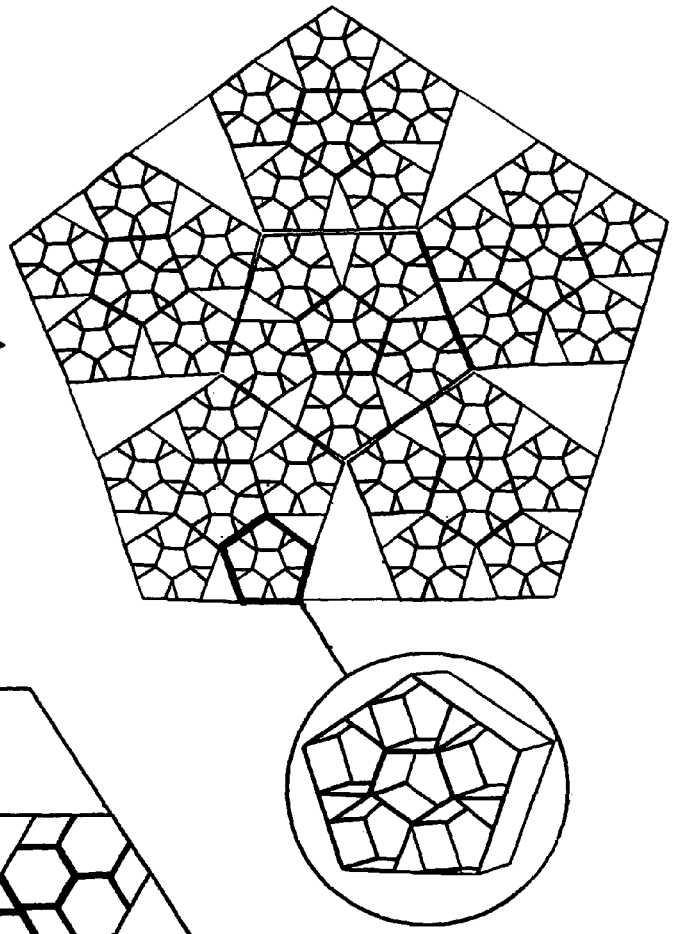
Pentagonal Cylinder formed from 4th lower level cylinders
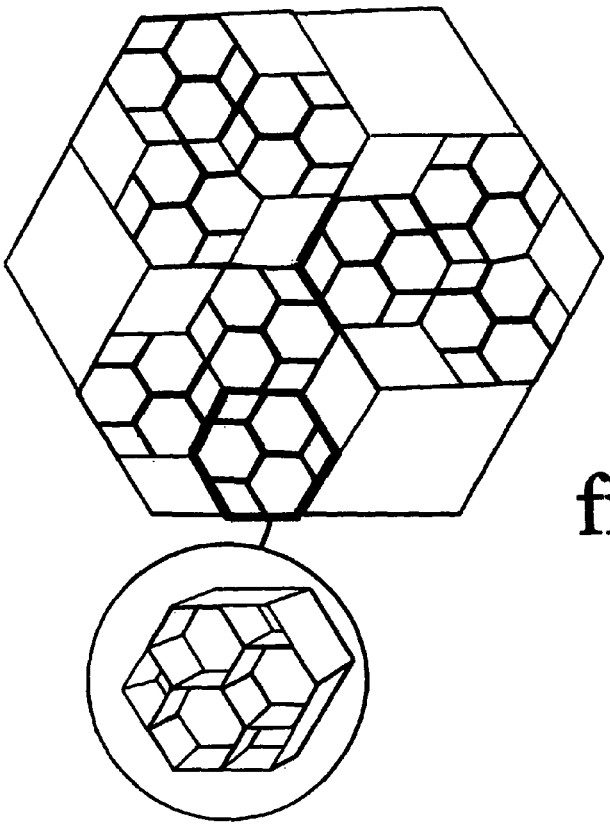
Hexagonal Cylinder formed from 4th lower level Cylinders
fig 21

Tapering angles through vertical plane of assemblage;

/a + {2./bc} + {2./de} + {2./fg} + {2./hi}

+ {2./jk} + {2./lm} + {2./no} + {2./pq} + /r

= 18 tapering angles

/a + {2./cd} + {2./ef} + {2./gh} +/j fig 26a
View from Ground level
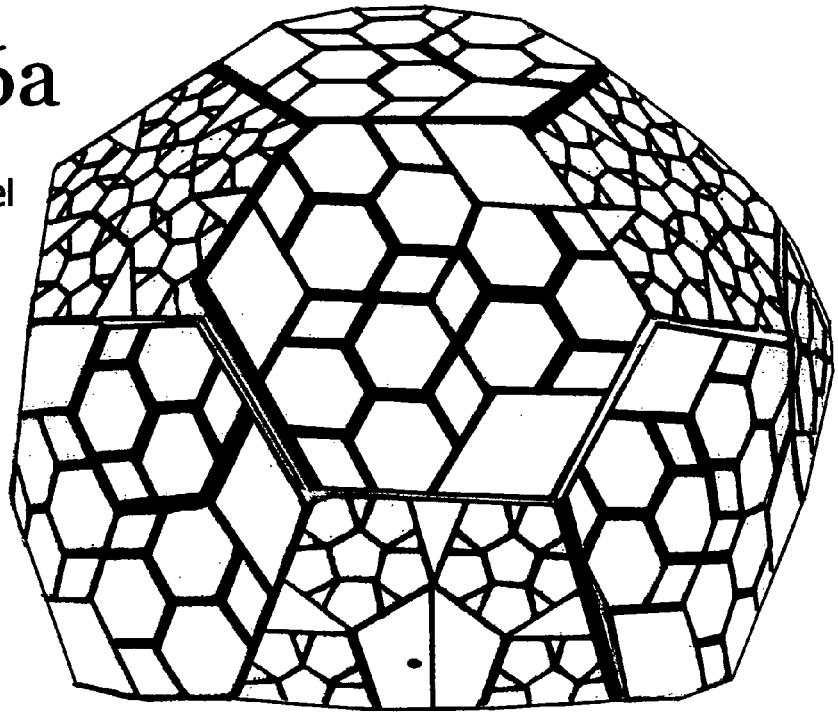
¾ Sphere formed from 3rd lower level cylinders (Frustums)
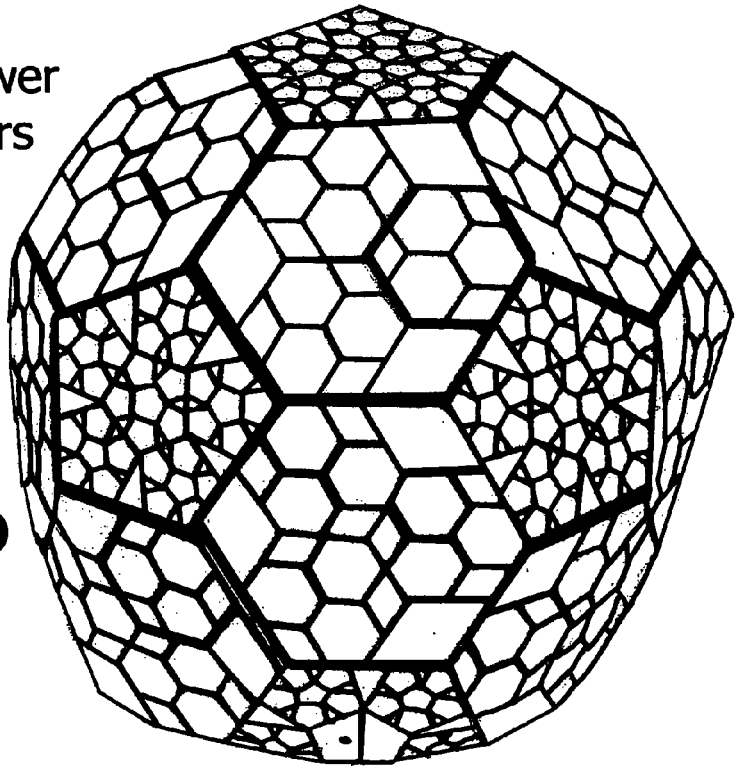
fig 26b
View from above looking downward at 45° angle

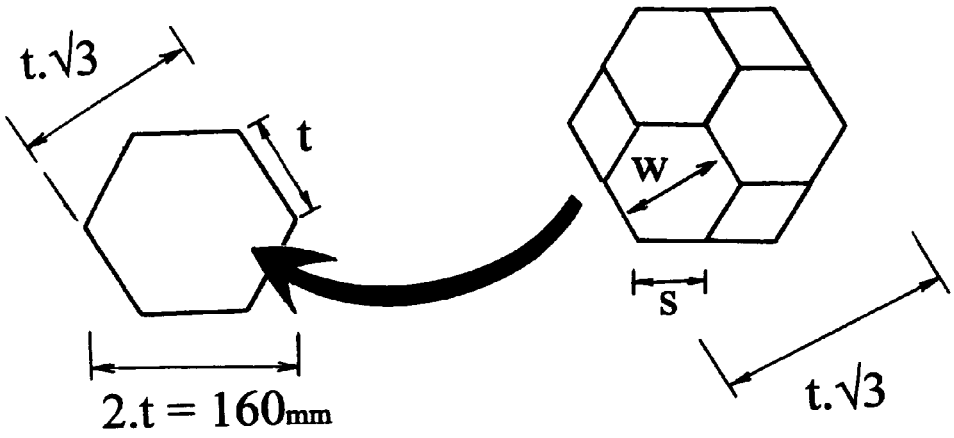
fig 27a
Interior perimeter of outer base of 5th lower level frustum
fig 27b
Conglomerate of 2nd lower level hexagonal cylinders to fit inside a 5th lower level frustum
fig 28a
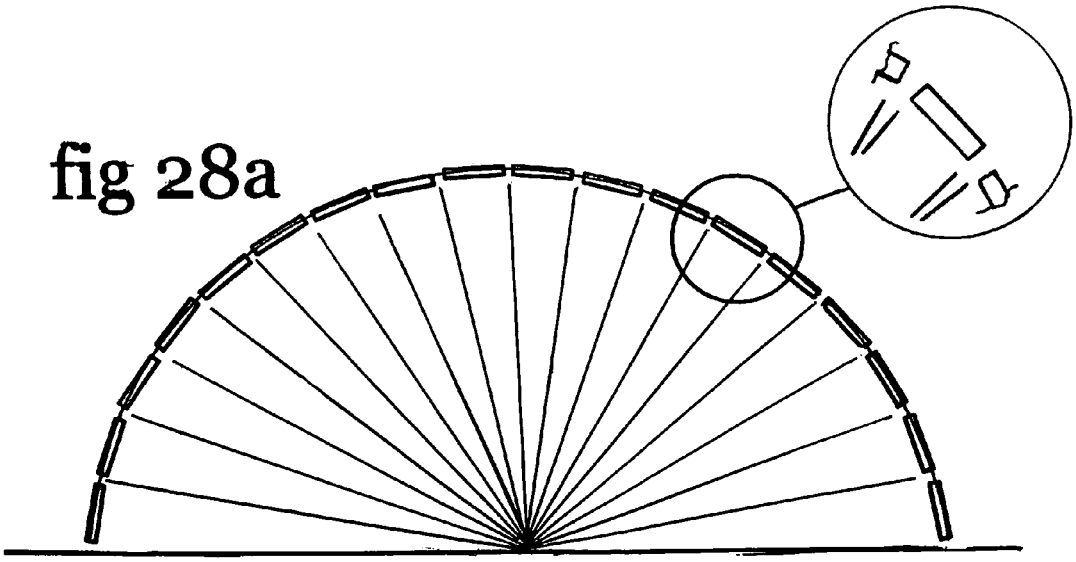

fig 28b
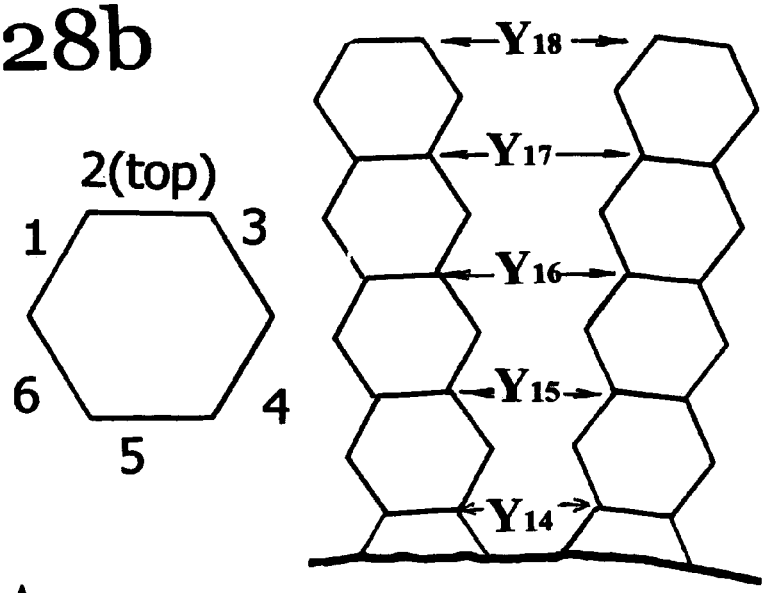
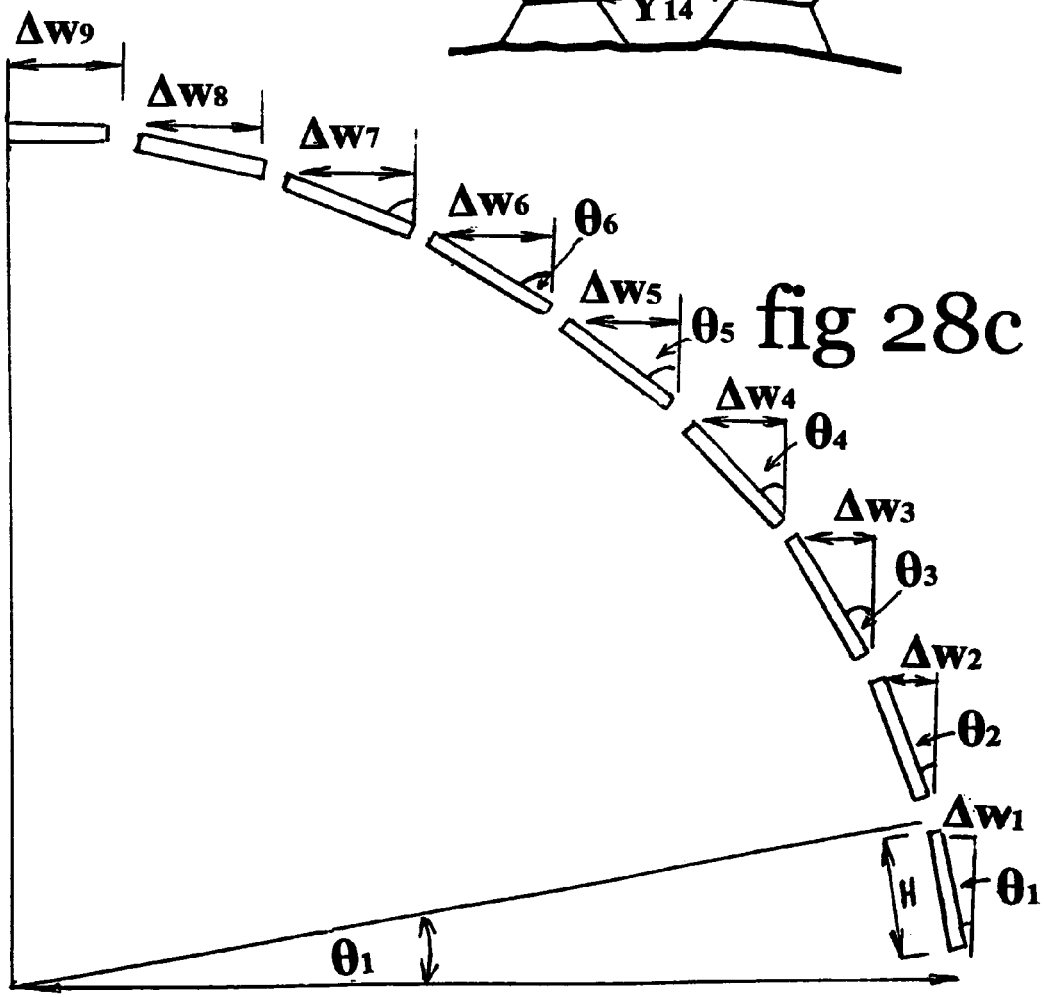
fig 28c

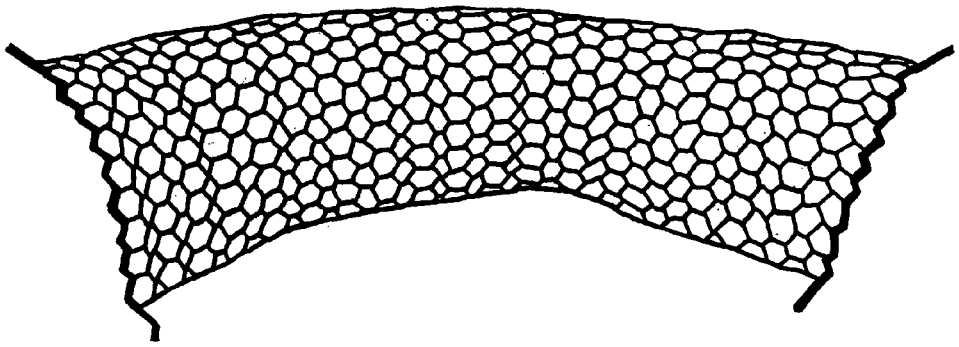
fig 31
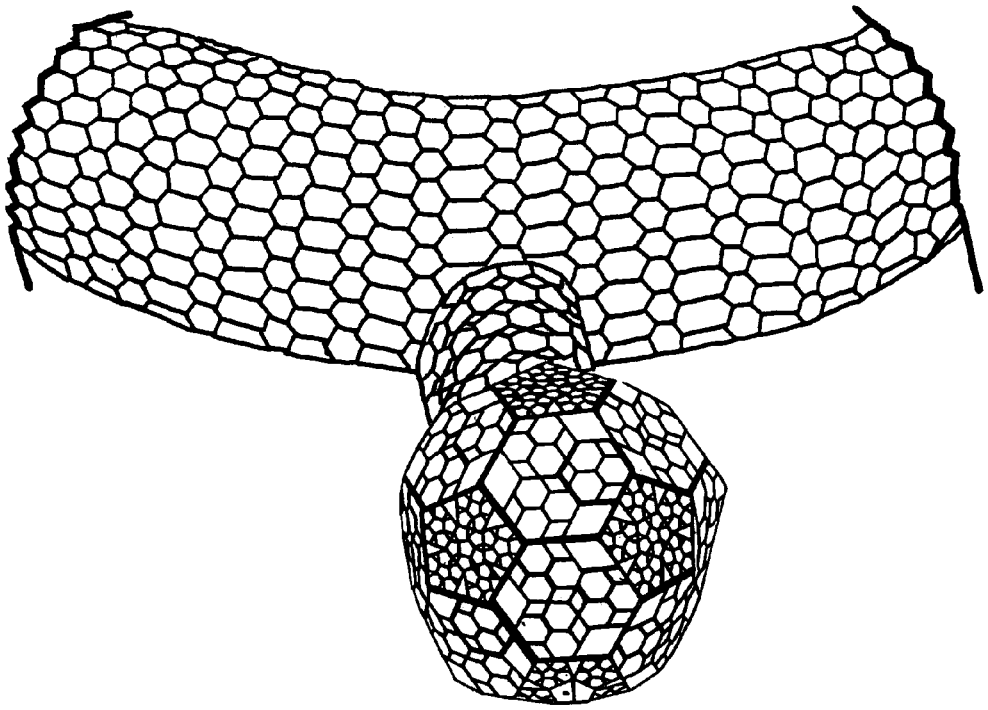

Spheres formed from 3rd lower level frustums connected to straight tubular corridors formed from 2nd lower level frustums Space Station constructed from the Geodesic Honeycomb Skeleton; Spheres formed from 3rd lower level frustums; Corridors formed from 2nd lower level frustums

METHOD OF CONSTRUCTION USING A GEODESIC HONEYCOMB SKELETON

This application is a continuation-in-part of application Ser. No. 12/215,369 filed on Jun. 25, 2008 now abandoned.

BACKGROUND OF THE INVENTION

During the time since the first dome structure was constructed, that could be called "Geodesic"; on top of the roof of the Carl Zeiss Optical Company in Jena Germany in 1922, the Science of Geodesic domes and structures has grown and evolved substantially. Shwam in U.S. Pat. No. 4,907,382 provides a categorization of various systems of Geodesic Domes and types of Fabrication. Shwam defines "Geodesic Domes" as being characterized such that "the outer surfaces of all Geodesic Domes are (either actual or implied) subdivided into triangles" In Mathematical terms "Geodesic" is defined as being "the shortest path between two points on any surface". In Civil Engineering terms "Geodesic Structures" are defined to be "structures consisting of a large number of a few identical parts and therefore simple to erect; and whose pressure is loadshed throughout the structure, so that the larger it is the greater it's strength". The Geodesic Dome is known to a very strong structure and the only structure that becomes stronger as it's becomes larger.

Pioneering work in the formation of geodesic domes was achieved by Robert Buckminster Fuller U.S. Pat. No. 2,682,235. A detailed description of the forces present in the geodesic domes proposed and constructed by Buckminster fuller is given by Lanahan U.S. Pat. No. 7,452,578 B2. Fishbeck in U.S. Pat. No. 7,389,612 provides a detailed description of the framework and planar elements used in the formation of the domes constructed by Buckminster Fuller.

Fishbeck also discusses the merits of constructing spherical structures from simple structural elements that are easily manufactured rather then the planar elements needed to be fastened along predetermined gridlines as in the domes constructed by Buckminster Fuller. So these merits will not be discussed again here.

A detailed description of geodesic spheres formed from pentagonal and hexagonal elements in terms of analytical spherical geometry can be found in U.S. Pat. No. 4,679,361 by Craig Yacoe. Other methods of constructing geodesic structures from discrete elements for diverse uses have been proposed; Lanahan U.S. Pat. No. 7,452,578 proposed structural fabrics formed from interconnecting uniform arrays of icosahedra members and also interconnecting carbon-60 molecule icosahedrons with these structural fabrics having a diverse range of applications. Mori U.S. Pat. No. 4,509,500 proposes a solar energy collection apparatus as part of a transparent geodesic sphere. In terms of this present invention, the geodesic sphere proposed by Mori is formed from $1^{st}$ level Hexagonal and Pentagonal elements but as will be understood from this disclosure, this is not the most practical method of constructing a geodesic sphere.

Roberts U.S. Pat. No. 5,560,151 describes a method of constructing geodesic domes constructed from hexagonal and pentagonal building blocks that are formed from a lower level of tri-angular building blocks. These building blocks described in the Roberts disclosure show indentations on the inner side joining surfaces of the blocks to facilitate the cementing together of the blocks and also orifices on the outside surfaces of the blocks which can be used by fasteners to hold the blocks together. But by either methods such an assemblage of building blocks will be reduced to a pile rubble in a powerful enough earthquake. Roberts proposes a building structure comprising 90 percent weight of ceramic material. Again, in an earthquake an enclosure made mostly from ceramics will crack-up and crumble. The Roberts disclosure proposes a building structure comprising of 90 percent weight of plastic material; Should a fireball erupt inside such an enclosure the intense heat could collapse the structure. The Roberts disclosure proposes building structure is proposed comprising 90 percent weight of metal but it will be the same scenario should a fire erupt inside the building structure. Such deficiencies in methods of the prior art require methods of creating structural assemblages using building parts which not only can be fastened together in a robust manner but also combine at least two different materials with this combination protecting the structural assemblage from harsh conditions in the environment. This is especially important because there is no one material in existence possessing all the intrinsic properties to withstand the combined effects of excessive heat; excessive shock; excessive vibration; and excessive force impacting upon it.

The method of constructing geodesic structures of this present invention differs from the prior art in that the hollow hexagonal pyramidal frustums and the hollow pentagonal pyramidal frustums can be fastened together using bolts that protrude through each interior side of each joining frustum in the network of frustums which are formed from lower levels of hollow polygonal pyramidal frustums so that what is infact obtained is a mosaic of pyramidal frustums all fastened together to provide a structure of superior strength.

Fishbeck U.S. Pat. No. 7,389,612 proposes geodesic structures made from discrete elements which can be assembled to form a geodesic dome. The geodesic dome proposed by Fishbeck is made up of discrete elements referred to as 'hub elements' in an 'approximate' fashion in that the elements are overlapping or tangentially touching adjacent elements. Fishbeck proposes various kinds of hub elements, amongst these elements a tapered tri-angular tube element that can be used to construct a structure with curvature such as a geodesic dome. The embodiment of this present invention differs from the method proposed by Fishbeck in that the elements used in the formation of geodesic structures disclosed herein are, to be precise, hollow pyramidal frustums formed from lower levels of hollow pyramidal frustums and significantly different from the tapered tri-angular hub elements proposed by Fishbeck; the angle by which the sides of the hollow pyramidal frustums slant must be precisely calculated so that each side of each truncated hollow cone in the geodesic network will join in a flush join such that the entire length and width of the joining surface will be a flush join.

This requires that the elemental hollow pyramidal frustums, be specially manufactured by methods of sand-casting or die casting. It must also be stressed that this invention requires that the hollow pyramidal frustums be designed so that all the side faces joining together do infact join together for the 'entire' length of the side surface. Unless the structure consists of a network of flush joins it will not be inherently robust and provide an ultimate strength for a specific material of specific tensile strength. It also needs to be stressed that if one is to attempt to construct a spherical enclosure such as a geodesic dome using the tapered triangular tubes proposed by Fishbeck by the method disclosed herein then two different tri-angular tubes would be needed; hollow equilateral tri-angular tubes to form the lowest level hexagonal pyramidal frustums and hollow isosceles tri-angular tubes to form the lowest level pentagonal pyramidal frustums. But then the design problem becomes vastly complicated because to achieve totally flush joining surfaces the angles by which the side surfaces of the tubes taper will be different on the isosceles tri-angular tube; the two tapered sides joining together to form the pentagonal truncated cone will be different than the tapered side that joins with tapered sides of other truncated cones to achieve totally flush joins in the network of joins in the Geodesic structure. Same for the equilateral tri-angular tapered tubes. Also new calculations for the number of tubes needed and the angle of taper on the sides of the tapered tri-angular tubes are needed than those given by Fishbeck.

This honeycomb skeletal enclosure formed from the hollow Pentagonal and Hexagonal pyramidal frustums of this present invention differs from previously proposed Geodesic structures such as the polyhedral structure proposed by Yacoe in U.S. Pat. No. 4,679,361 in that this skeleton is formed from a network of hollow pyramidal frustums (FIG. 3*a* & 3*b*) the thickness and length of the hollow pyramidal frustums can be chosen, such that, for a material of given tensile strength, a Geodesic honeycomb skeleton can be erected which would be the strongest structure formed, and which could be formed using this material

SUMMARY OF THE INVENTION

The main component of this invention is a honeycomb skeleton made up of hexagonal and pentagonal pyramidal frustums. These hexagonal and pentagonal frustums might resemble hexagonal and pentagonal cylinders (FIG. 1*a* & FIG. 1*b*) and if this method of construction is adopted by in industry then the frustums could become known as cylinders but it must be kept in mind that by strict definition the side surface of a cylinder is completely rounded and does not have an apex as defines a pyramid. Many spheres and tubular corridors constructed in the manner described herein, could be linked together, thus forming a structural continuum. This skeleton is based on the closed cage highly symmetrical Carbon-60 molecule; a complete sphere known as buckminsterfullerene or simply as a "Buckyball", in honor of R. Buckminster. This molecule has attracted a lot of interest since it's discovery in 1985; by chemists and also mathematicians have been interested in the symmetry properties of $C_{60}$ and related closed cage molecules. (FIG. 2)

The skeletal spheres referred to herein and that form parts of the proposed structural continuum are truncated spheres and when consisting exclusively $1^{st}$ level Hexagonal and Pentagonal pyramidal frustums are described by mathematical terminology as "Truncated Icosahedrons" but will be referred to herein onwards as ¾ spheres.

These frustums are best suited to be manufactured by methods of sand-casting, however, depending upon the choice of material and dimensional tolerances required for the cylinders, Die-Casting could be the preferred choice for manufacturing them. For a Sand Casting method of manufacture, tooling would be needed and this tooling could be made from Aluminum or Timber. These polygon frustums could be cast from Iron, however, a strong aluminum alloy might be more suitable. A polymer of superior tensile strength might also be suitable.

These Hexagonal and Pentagonal pyramidal frustums will require an angle of taper on the outer side surfaces such that the required angle of Taper will be a function of the LEVEL of spherical enclosure; the geodesic dome that is desired to be constructed.

The formation of tubular corridors would be similar to the formation of Carbon-60 molecules in Carbon-60 nano-tubes. A unique aspect to this structural continuum is than a section of it could be seen to be a macroscopic representation of the molecular world.

An assessment can be made of a Structural Continuum erected from these Hexagonal and Pentagonal frustums, in that, this assessment provides an overall Quality rating of the structure; due to two aspects; Firstly; the tensile strength of the material from which the cylinders are cast and secondly; the heat resistance of the material used to create the skin that protects the skeleton. The Structural Continuum is referred to as comprising of two embodiments discussed herein; The Honeycomb skeleton and also the skin protecting the skeleton. It is this combination of a Honeycomb Skeleton and Skin which will provide the Structural Continuum it's overall Quality rating $Q_{sc}$. It is suggested that $Q_{sc}$ be a number assigned between 1 and 10; the higher the number assigned to a structure the higher it's quality. Ideally, a material of high tensile strength would be used to create the honeycomb Skeleton and a material that is highly heat resistant would be used to create the skin that covers the skeleton. These superior materials would create a Structure of Superior $Q_{sc}$; a superior $Q_{sc}$ would be interpreted to indicate a structure being immune from the devastating effects of earthquakes, tornadoes and possibly, also, bushfire.

A unique aspect of this structural innovation is that the hexagonal frustums can be formed from a lower level of hexagonal and polygonal cylinders frustums and these lower level hexagonal frustums could also be formed from a lower level of hexagonal frustums and the same for the pentagonal frustums. These cylinders are in fact sections of hollow pyramids and the overall strength of the skeleton will be a function of;

a) the volume of mass forming the identical hollow frustum b) the tensile strength of the material of which the cylinders are cast c) a constant for the lowest level frustums forming the skeleton.

In the hypothetical case where the dimensions of these cylinders are extended to make them into solid pyramidal frustums then the structure will no longer resemble a skeleton but a solid enclosure of mass and will thus be of ultimate strength. In the other extreme in which the dimensions of the cylinders are as small as realistically possibly; the skeleton will only be a thin mesh outline, and thus, be of minimal strength. However, between these two extremes, there will exist dimensions for the frustums, such that, the strongest skeleton can be erected for a particular material of given tensile strength.

Besides it's inherent strength, the proposed structural continuum has another advantage; this is that it is easy to assemble; Once tooling for the manufacture of the polygon cylinders has been designed and built, and it is seen that prototype parts connect together correctly, the continuum can be easily expanded upon.

A huge number of spheres, and tubular corridors and circular tubular corridors could be linked together over a flat land mass thus forming a structural continuum . . . only limited by the extent of flat land available. But, in the case where this structural continuum is used to erect a space station or space dwelling; the continuum can expand out into the infinity of space indefinitely.

There are four main components needed in the construction of this Novel Geodesic structure described herein; which will result in a viable alternative to conventional structures, being erected, which can be used as a dwelling space or as Civil Defense shelters. With the prevailing predicament on our planet, and in recent years, with tornadoes, hurricanes and earthquakes bringing devastation upon communities of people, especially in the United States, structures built up from the method described herein would be a viable and practical alternative to current methods of construction. This Structural continuum could be a viable option in the building of space stations or space dwellings as the continuum could easily be assembled in space.

BRIEF DESCRIPTION OF THE DRAWINGS

FIG. 28*a* & FIG. 28*b* & FIG. 28*c* & FIG. 28*d* & FIG. 28*e* & FIG. 28*f* & FIG. 28*g* diagrams needed for the explanation to the solution for Example 7

DESCRIPTION OF THE PREFERRED EMBODIMENTS

The Embodiments comprising the invention are as follows;

POLYGON CYLINDERS FORMING THIS HONEYCOMB SKELETON

HEAT INSULATING GASKET

CERAMIC U-BAR AND WEATHER RESISTANT FILLER

SWITCHABLE PHOTOREFRACTIVE WINDOWS

Polygon Cylinders Forming this Honeycomb Skeleton

Figure 4B:
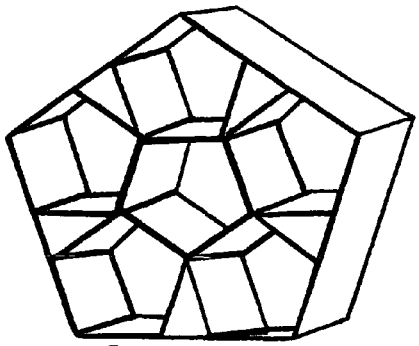
Figure 4A:
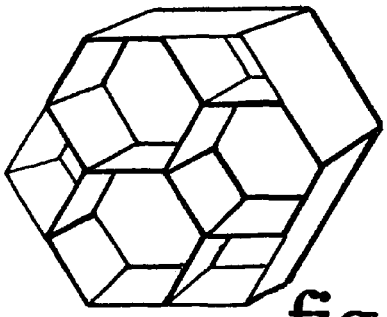

The critical feature of this method of construction is that the hollow polygonal frustums can be fastened together using bolts which protrude through each interior side of each joining frustum in the network of frustums to provide a structure which is securely robust. The Hollow Frustums forming this honeycomb skeleton referred to herein as the "$1^{st}$ level of frustums" could, and ideally would be formed from a smaller level of hollow Hexagonal and Pentagonal pyramidal frustums . . . referred to herein as the "$2^{nd}$ lower level of frustums". Each hollow pentagonal frustum would be formed from 6 smaller hollow pentagonal frustums and each hexagonal frustum would be formed from 3 smaller hollow hexagonal frustums and 3 quadrilateral pyramidal frustums. (FIGS. 4*a* & 4*b* show cylinders formed from "very thin" $2^{nd}$ lower lever frustums). These $2^{nd}$ lower level of frustums could be formed from a network of smaller frustums; a $3^{rd}$ lower level of frustums, and these frustums being formed from a $4^{th}$ lower level network of frustums and so on. A Constant for a skeleton formed from an $n_{th\text{-}level}$ frustums is designated herein as; $K_{nth\text{-}level}$ For a ¾ sphere (FIG. 5*a*) formed from this honeycomb skeleton with only a $1^{st}$ level of Hexagonal and Pentagonal frustums; there will be 15 Hexagonal frustums (Hex-fru) and 11 Pentagonal frustums (Pent-fru) required; and in general, the number of frustums contained in a skeleton formed from an $n_{th\text{-}level}$ of frustums will be; (let $a=n_{th\text{-}level}-1$)

$$\Sigma\text{Polygon Cylinders}=\Sigma\{15[3^a]\text{Hex-fru.}+11[6^a]\text{Pent-fru}\}$$

Figure 1A:
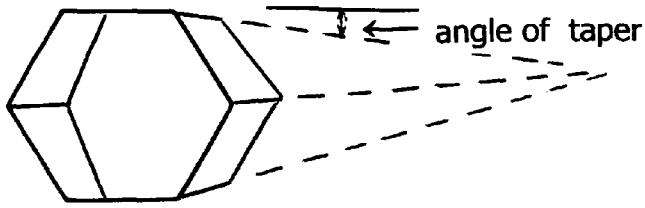
FIGS. 1*a* and 1*b*; The outer surfaces of the pyramidal frustums tapering to a point FIG. 2; A C-60 molecule FIGS. 3*a* & 3*b*; The pyramidal frustums extended to form Pyramids FIG. 4*a* & 4*b*; Very thin $2^{nd}$ lower level Hexagonal and Pentagonal frustums forming larger $1^{st}$ level frustums FIG. 5 A ¾ sphere formed from $2^{nd}$ level frustums FIG. 6; Cross-Sectional view of a frustum FIG. 7*a*; Plane through Soccer Ball with diagram showing the total angle formed by one pyramidal frustum through the plane of the diameter FIG. 7*b*; Piece of Soccer Ball Removed FIG. 8; $2^{nd}$ lower level Hexagonal "sub-frustums" within one $1^{st}$ level hexagonal frustum, showing (in 2 directions) 4 angles contributing to the overall curvature FIG. 9*a*; A Tubular corridor, and FIG. 9*b* frustums showing the surfaces requiring a taper FIG. 10; Approximating the pyramidal frustums as circular cones of a set thickness FIG. 11*a*; A segment of circular tubular corridor and FIG. 11*b*; a Circular tubular corridor FIG. 12; A ceramic U-Bar FIG. 13*a* and FIG. 13*b* Joining corridors; showing polygons designed to be the joining frustums FIG. 14; The $1^{st}$ level frustums put into place to construct a skeleton.
Figure 1B:
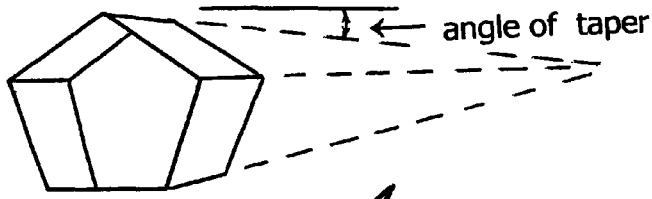
Figure 2:
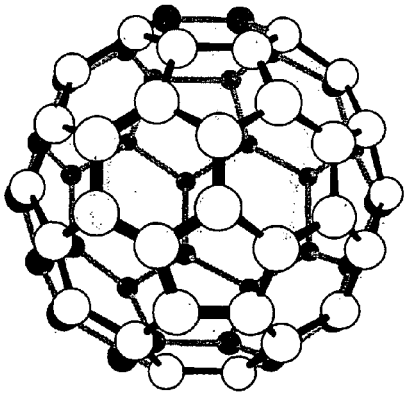
Figure 3A:
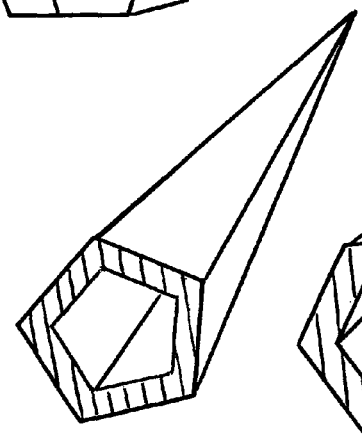
Figure 3B:
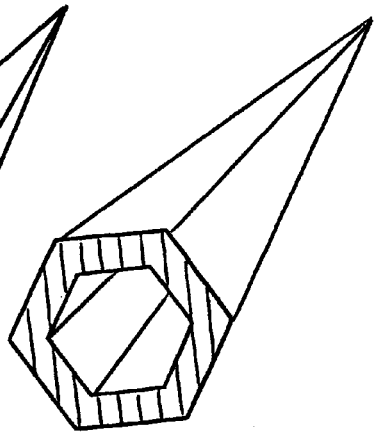
Figure 16A:
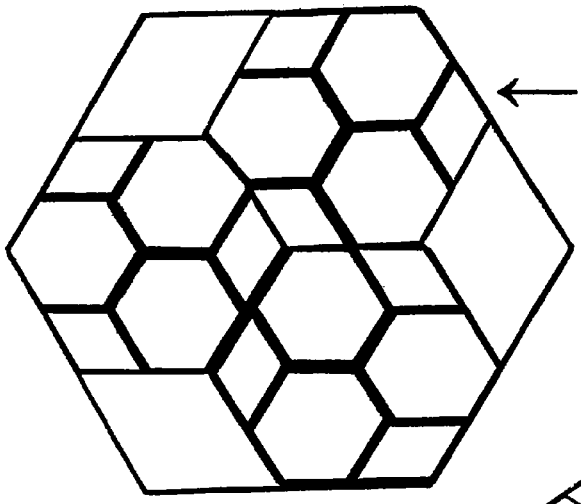
FIG. 16*a* & 16*b*; $1^{st}$ Level frustums formed from $3^{rd}$ Lower Level frustums FIG. 17; Plan of a skeleton formed from $3^{rd}$ lower level frustums FIG. 18 & FIG. 19; Enlarged views of skeleton showing assemble of pyramidal frustums FIG. 20 & FIG. 21; Enlarged View showing assembly of $4^{th}$ level pyramidal frustums FIGS. 22*a*; 22*b* & 22*c*; extension of drawing of FIG. 8 to determine the number of tapering side surfaces on $3^{rd}$ lower level frustums FIG. 23*a* & 23*b*; end view of pyramidal frustums formed from $5^{th}$ lower level pyramidal frustums FIG. 23*c*; Hexagonal frustum showing outer base and inner base for solution to design problem FIG. 23*d*; cut away view of hexagonal pyramidal frustum FIG. 23*e*; pentagonal pyramidal frustum FIG. 24; top view of geodesic honeycomb sphere connecting to tubular honeycomb corridor showing joining frustums FIG. 25; fold up cut out that will fold up to a ¾ geodesic sphere FIG. 26*a* & FIG. 26*b*; ¾ Geodesic honeycomb spheres formed from $3^{rd}$ lower level frustums FIGS. 27*a* & 27*b*; Conversion explanation diagrams for solution to Example 6
Figure 16B:
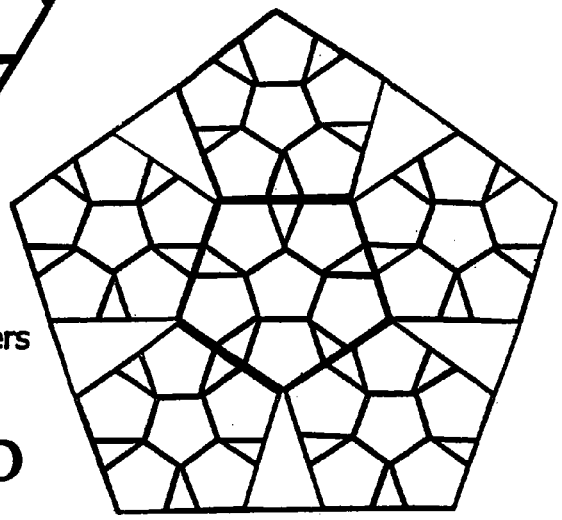

It is essential that a precise definition of a LEVEL be given as it applies to this disclosure; the assembly of these hexagonal and pentagonal frustums from smaller hexagonal and pentagonal frustums can be equated to the self similarity of geometrical objects known as fractals. The largest level of hexagonal and pentagonal frustums can be seen as a simple fractal because as can be seen in FIGS. 16*a* and 16*b*; a pattern is emerging of identical polygon parts at different scales. A full sphere based on the carbon-60 molecule (FIG. 2) or Soccer ball (FIG. 7*a*) are described in geometrical terminology as truncated icosahedrons as previously stated and when formed from $1^{st}$ lower level frustums the number of frustums contained in the sphere will be $$(a=n_{th\text{-}level}-1=1-1=0)$$

$$\Sigma\text{Polygon Cylinders}=\{20[3^{a}]\text{Hex-fru.}+12[6^{a}]\text{Pent-fru}\}$$

which gives 20 hexagonal frustums plus 12 pentagonal frustums. Each frustum can be seen to form a boundary. The level of the sphere can be designed (or ascertained) from the number of either pentagonal frustums or hexagonal frustums that will be formed to fit within the boundary. For example, if within the boundary of the largest hexagonal frustum there is nine smaller hexagonal frustums, then the sphere is formed from $3^{rd}$ lower level as can be seen from FIG. 16*a*. The numbers of the frustums in the lower levels are given by the above summation formula. The same formula applies to designating the levels of the tubular corridors. The choice of LEVEL is significant because the larger the diameter of the sphere or tubular corridor that is intended to be designed using this method, then the lower the level of hexagonal frustum the enclosure will require to provide a superior strength. FIG. 18 and FIG. 19 show an expanded view of the smallest frustums in $3^{rd}$ lower level honeycomb skeletons. FIGS. 20 & 21 show $4^{th}$ level assemblies.

In Geodesic terminology, the term 'frequency division' and frequency subdivision is used. For example; when all the tri-angular sections in an Octahedron are divided in two; . . . mathematicians refer to the resulting polyhedron as a two frequency octahedron Of critical importance is the angle of Taper on the outer surfaces of the frustums. From a cross-sectional view of the frustums (FIG. 6 showing a sliced section of a frustum) the inner surfaces of the frustums will be perpendicular to the inside edge of the frustum, however the outer surface of the frustum will require an angle of Taper. For a honeycomb skeleton formed from a $2^{nd}$ lower level of frustums, this angle of Taper will need to be 9 degrees. This can be deduced from slicing a plane through the largest diameter on the Soccer Ball. (FIG. 7) It will be found that there will be a total of 10 angles around the circumference arising from joining the $1^{st}$ level cylinders. Thus each angle between adjacent sides on a $1^{st}$ level cylinder will be 360/10=36 degrees, and thus, the angle between one side of the same frustum and the centre of this frustum will be 18 degrees. (FIG. 7*a* and FIG. 7*b* showing the section of soccer ball removed)

It is also easily deduced that the diameter of a sphere built up from the honeycomb skeleton as a function of the Diameter of the $1^{st}$ level of polygon frustums will be;

$$\text{DIAMETER OF SPHERE}=2*\{\text{Rad-fru}/\text{Tan}(\theta/2)\}$$

Where Rad-fru is the radius of the polygon frustums and θ/2=18 degrees

From joining the $2^{nd}$ lower level sub-frustums together to obtain a $1^{st}$ level Hexagonal frustum (FIG. 8) it is seen that there will be four angles contributing to the overall Taper of the smaller frustum to form a larger frustum. This can be seen from FIG. 8 where the contributing angles are formed from vectors [ab+{cd*2}+ef]. Thus, the angle of Taper on each $2^{nd}$ lower level frustum will be; 36/4=9 degrees and in general, for a honeycomb skeleton made up of an rith level of polygonal frustums the angle of taper required will be; (let $a=n_{th\text{-}level}$)

For lowest level Hexagonal frustums; angle of taper=$36/(2^{a})$

For lowest level Pentagonal frustums; angle of taper=$36/(3^{a-1})*(2)$

It is suggested that the around both the outer and inner faces of the, on the outer edge (FIG. 6) that there be a indentation of approximately 20 mm by 5 mm and also, if possible, a small cavity within the outer edge of the frustums. The outer indentation will be useful for fitting bus wiring to connect to the photorefractive window material, described in a following section. The inner indentation will be required for these sheets of photorefractive material to sit in.

It is suggested that a suitable length for the $2^{nd}$ lower level of frustum be between 100 mm and 200 mm and the thickness of the Hollow frustums be 20 mm at the outer edge. Depending on the tensile strength of the material which the hollow frustums are cast from the thickness of them could be as thin as 10 mm at the outer edge and still form a robust Honeycomb skeleton of immense strength. These hollow frustums need be bolted together at two places at each joining face, and thus, holes needing to be drilled in these places; identical places on each face of each cylinder and it is suggested that a stencil be made and used to mark the location of the holes. It is suggested that bolts of no less than M10 be used. It is this feature of the construction in which each frustum is joined to it's neighboring frustum that will provide a structural enclosure of immense strength.

The formation of tubular corridors can be achieved by using only hollow hexagonal frustums and hollow quadrilateral frustums as indicated. (FIG. 9*a*) In this case, the frustums will only require an angle of taper on 2 of the 6 outer surfaces of the cylinder edges (FIG. 9*b*; shows these frustum surface edges marked 'T"). In this case the overall diameter of the tubular corridor will be a function of the degree of taper on the 2 outer surface edges of the hollow hexagonal frustums; The steeper the degree of taper the smaller diameter of the resulting tubular corridor.

A method for Quantifying the Overall strength of a honeycomb skeleton built out of a material of known tensile strength is proposed by modeling the skeleton on a structure formed from hollow cones (FIG. 10) (in a special case, the sections of hollow cones can be approximated to conical frustums).

I will assume here that the strength of the Honeycomb skeleton is equivalent to the stress in Newtons/meters^2 applied at one point to deform the skeleton. It is a known property of Geodesics that any force acting at a particular location on the structure is distributed throughout the structure. I will thus assume the dimension meters^2 to be the entire surface area of a unit sphere or tubular corridor of which the stress is applied. With an either linear or logarithmic proportionality constant linking the property of a single cone to the Strength of a skeleton formed from an $n_{th\text{-}level}$ of hollow cones (conical frustums) the Overall Strength can now be approximated;

(for the special case in which the hollow cones approximate frustums)

$$\text{OVERALL STRENGTH}=(\tau\text{cyl})(K_{nth\text{-}level})(\pi[C_{out}^{2}-C_{in}^{2}].\ C_{L})$$

Where $(\tau\text{cyl})(K_{nth\text{-}level})(\pi[C_{out}^{2}-C_{in}^{2}])\geq$Stress needed to deform the skeleton Subsequently, where the frustums are to be designed to yield an overall strength, then $$[C_{out}^{2}-C_{in}^{2}].C_{L}=(\text{OVERALL STRENGTH})/\pi(\tau\text{cyl})(K_{nth\text{-}level})$$

τcyl is the strength of the frustums; τcyl=(τk)(τ) where τk is a proportionality constant determined by the strength of the material used for the frustums and $\tau$ is assigned as being the rigidity modulus (elasticity of shear) which is the ratio of shear stress to the displacement per unit sample length (shear strain). $K_{nth\text{-}level}$ is the linear or logarithmic constant for a structure formed from an $n_{th}$ level of polygonal frustums; $C_{out}$ & $C_{in}$ denote the outer and inner radii of the frustum, thus $[C_{out}-C_{in}]$ denotes the frustum thickness $C_{th}$ and $C_L$ denotes the frustum depth and in the case where $C_{th}$ and $C_L$ approach maximum values, a sphere would approach a solid mass, but there will be values for $C_{th}$ and $C_L$ for which the sphere, or tubular corridor will be the strongest structure attainable for tensile strength of material.

It is anticipated that the Architect designing the Geodesic honeycomb structure will select the dimensions of the hollow pyramidal frustums for a material of known tensile strength to provide a honeycomb skeleton to be of a strength that is required for the anticipated conditions of the environment. For example, the dimensions of the pyramidal frustums could be selected such that the resulting honeycomb skeleton is a thin mesh outline but obviously such a structure will be torn apart in the path of a Tornado. On the contrary, the dimensions of the hollow pyramidal frustums could be selected so that the resulting honeycomb skeletal enclosure is of the other extreme which is partly solid mass. But such a structure will not be of any use either because it will not be possible to place bolts through the joining frustums to fasten the frustums together. Neither will it be of any use as an enclosure. However, there will be dimensions for the hollow pyramidal frustums that will provide an enclosure of ultimate strength for a material of known tensile strength. It needs to be stressed that Architect could design a honeycomb skeletal enclosure that would be the strongest structure for tensile strength of material for a given dimensional size. The proof of this is mostly intuitive; Because if the honeycomb skeletal enclosure is formed from solid pyramid then it will be a structure of solid mass and must be of ultimate strength. But of course, not much use as any kind of enclosure.

Figures 11A, 11B:
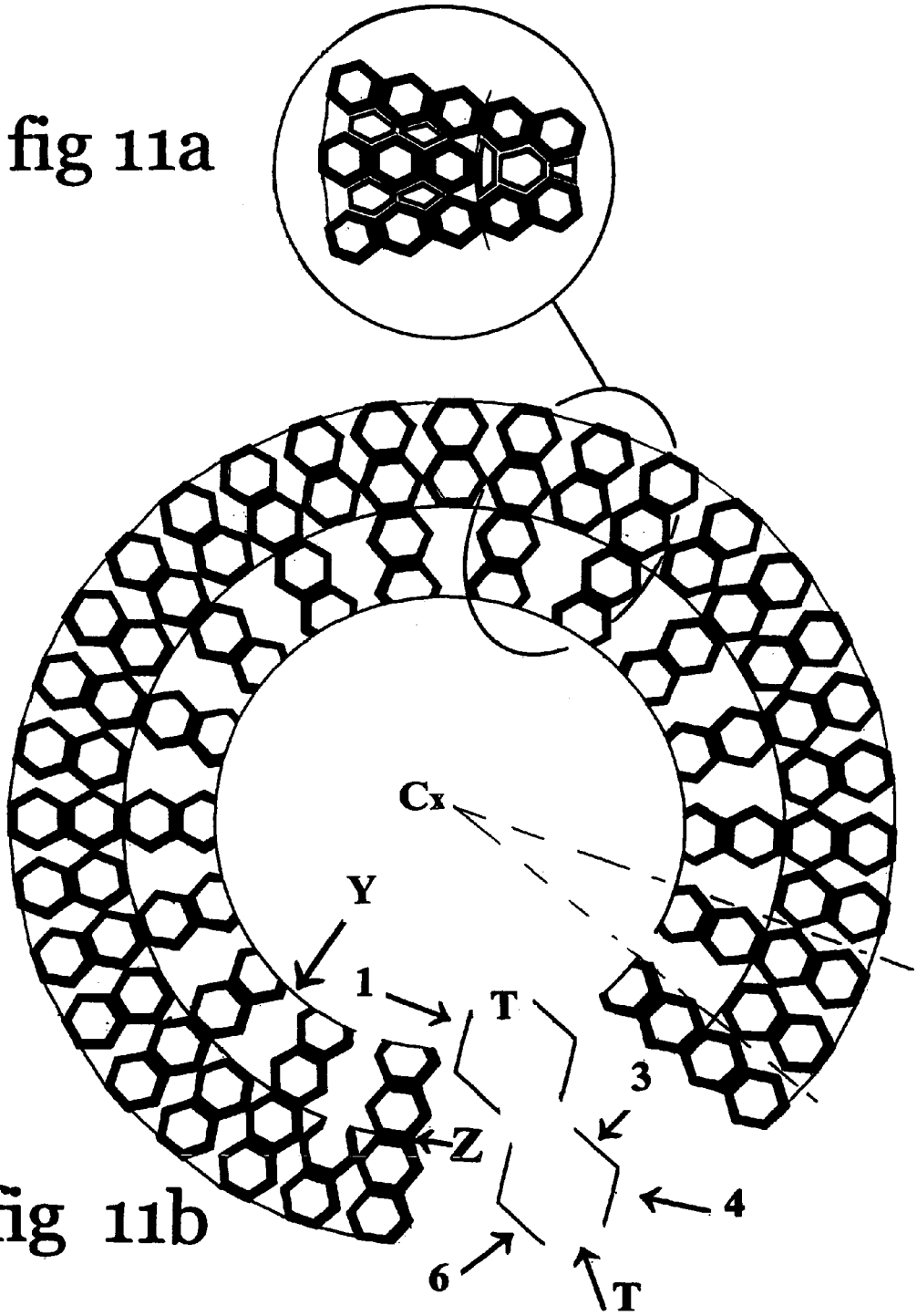

"Circular" tubular corridors can be achieved by again using Hollow Hexagonal frustums but, in this case, 4&5-sided hollow polygon frustums (as seen in FIG. 11*a*) will also be needed. These 4&5-sided hollow polygon frustums are the joining frustums to fit the space between the hollow hexagonal frustums and connect and form the network of hexagonal frustums into a circular corridor, The hollow hexagonal frustums will need to have the same angle of taper on 2 of the 6 outer surfaces of the frustums (same angle on same outer surfaces used for the Tubular corridor). The outer surfaces 1&3; 4&6 of the hollow frustums as shown in FIG. 11 will require a small angle of Taper between 2 and 4 degrees depending upon the "ROUND PATH LENGTH" that is desired. The "Round Path Length" of the circular tubular corridor will be a function of the size of the hollow hexagonal frustums and the angle they tilt towards the spokes radiating from $C_x$. (FIG. 11*b*)

It is seen looking down on the Circular Corridor (FIG. 11*b*) two Circular lines "Y" and "Z"; Line Z is the highest point on the roof of the Corridor and line Y is the inner horizon of the corridor. It is suggested that line Z be used as the measurement of the "ROUND PATH LENGTH".

In Quantifying the strength of the corridor, it will not be correct to take the area over which the stress is applied to be the total surface area of the corridor. Instead it is suggested that;

$$(\tau cyl)(K_{nth\text{-}level})(\pi[C_{out}^2-C_{in}^2].C_L)$$

be calculated for the surface area at the cylinder where the stress is applied plus the surface area of the cylinders that are directly connected to it.

Figure 13A:
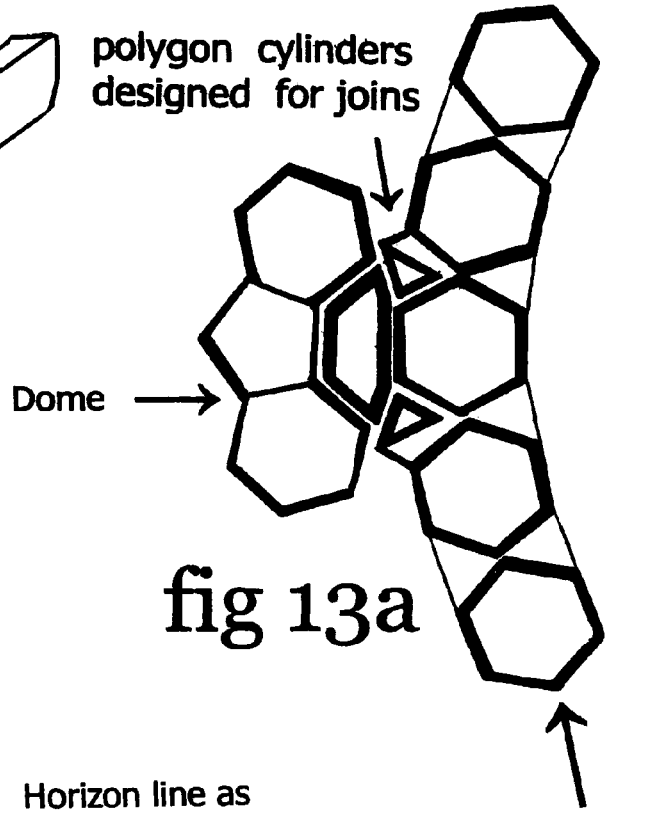
Figure 13B:
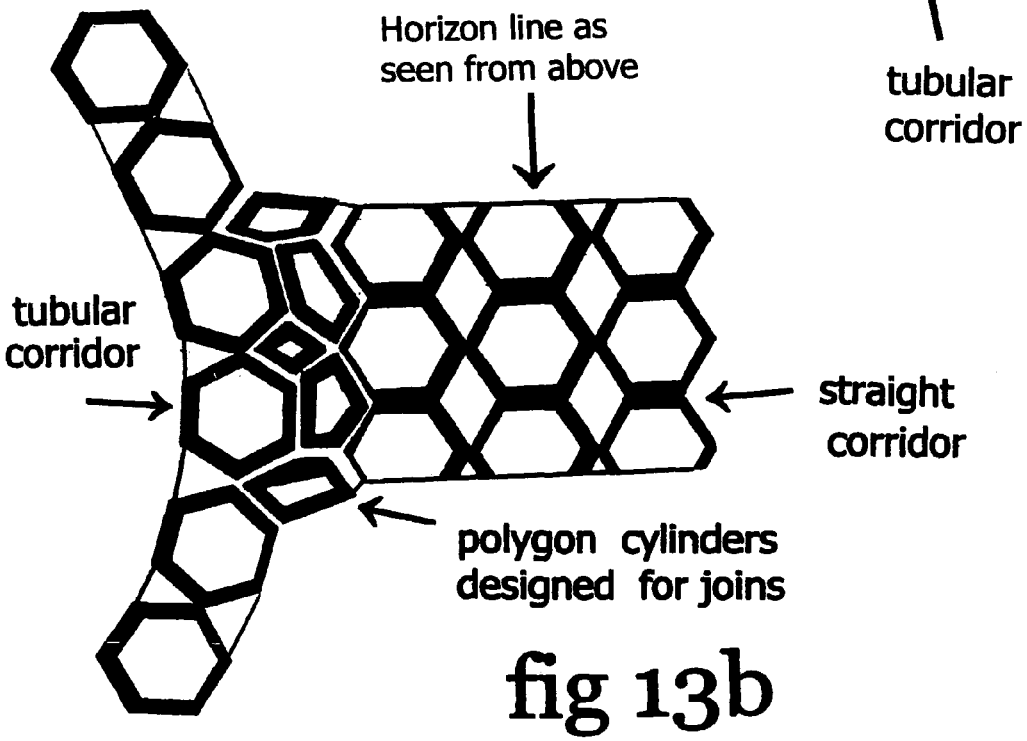
Figure 24:
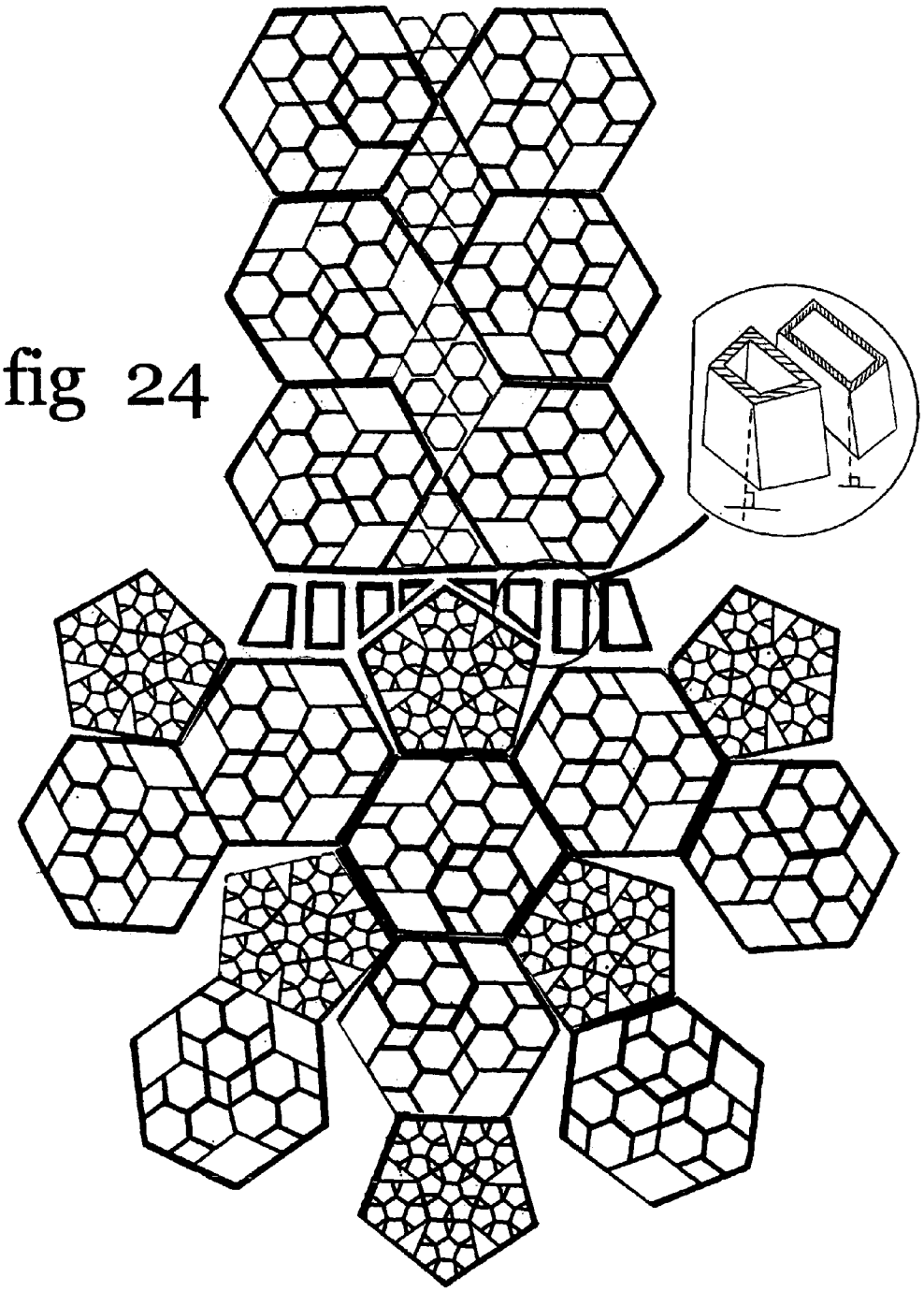

It is seen that the most practical method of assembling this structural continuum consisting of many ¾ spheres and tubular corridors linked together, is to assemble it starting from the top downwards; that is; the top frustums are joined into position first and then the surrounding side frustums are joined. An unconventional method ofcourse when considering how most buildings are constructed. A problem arises when joining the tubular corridors into the ¾ spheres. Solving this problem requires hollow polygon frustums specially designed and Die-cast to fit the space in which two frustum surfaces are to be joined. These joining frustums are shown in FIG. 24. It can be seen in all cases, this is an easy engineering problem to solve: As stated, the continuum is constructed from the top first; The top frustums of the ¾ sphere and the top frustums of the tubular corridor need to placed in close proximity. The hollow Polygonal frustums are then designed and made from Timber that will fit this space and connect the surfaces; This wooden polygon frustum is then used to make the cast (and kept to make more casts). Tubular corridors will, also, need to be joined with a "Circular" tubular corridor using irregular shaped frustums and this case is shown in FIG. 13;

Heat Insulating Gasket

Heat Insulating Gasket will be required to be placed between each joining surface of the frustum. The properties of this gasket material should be such that it be heat insulating. Ceramic sheeting between 1 mm and 2 mm thick in thickness; such as silicon nitride which is known to withstand temperatures up to 1000 degrees Celsius would be a suitable choice. Silicon Carbide or Cubic Boron Nitride would also be ideal.

It is essential that the hollow frustums be insulated from each other by heat insulating gasket as in a circumstance where a fire erupts inside the structures; a vast amount of heat emanating from a fire inside the structure could weaken and eventually collapse the honeycomb skeletal enclosure. However, when each frustum is insulated form it's neighboring frustum in the skeleton, the heat energy required to weaken the entire structure would be much more substantial.

Ceramic U-Bar and Weather Resistant Filler

Figure 12:
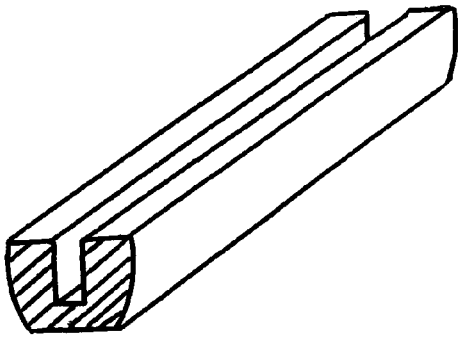

Ceramic U-Bar placed along the interior joining edges of the assembled honeycomb skeleton would provide additional protection to the skeleton in the scenario where a fire erupts inside the structure. These Ceramic U-Bars (FIG. 12) will form a continuous interior shell, thus protecting the skeleton and also adding a pleasant finish to the interior of the structure. This Ceramic U-Bar would be manufactured by common extrusion method. It is suggested that the Ceramic U-Bar be attached with bolts and spring washers with screw holes needing to be tapped into the edges of the frustums. It is suggested that two holes be cut out of the length of each Ceramic U-Bar to place the Bolts through. These holes would be cut out using "Water Jet Cutting" which is now the preferred method for cutting shapes out of Ceramic and Glass.

It is possible that other heat resistant materials will also be suitable for this U-Bar to form a continuous protective shell covering the interior of the skeleton. Ceramic would have one disadvantage in that; in the event of an earthquake or similar severe shock to the structure, a ceramic shell could crack in places with parts falling down. Thus, it is strongly recommended that the manufacturing process of the Ceramic U-Bar include encasing it in a polymer sheet/film of approximately 0.2 mm thick WEATHER RESISTANT FILLER will be needed to cover the gap at the exterior joining edges of the Geodesic skeleton. These joins would need to be filled over using a corrosion resistant filler. For this I suggest that an industrial grade silicon sealant be used. It is suggested that the gasket material be cut to be a few millimeters narrower than the sides of the cylinders.

Swtichable Photorefractive Windows

Switchable Photorefractive window material is suggested for the structure. Sheets of this material would need to be specially molded to fit, and to sit inside the outer interior step of the frustums. Switchable Photorefractive sheet is opaque in it's natural state but when a voltage is applied across it, the material becomes transparent to light. This Switchable Photorefractive Sheet is known more precisely as Polymer Dispersed Liquid Crystal (PDLC) film. PDLC film is made by dissolving a liquid Crystal material into a two part fluid mixture of polymer and cross-linking agent. With sheets of this Photorefractive window installed as the window material in the Geodesic structure, each cylinder forming the skeleton then becomes a Swicthable "photorefractive cell"

It is recommended that these sheets of photorefractive window material be molded such that the sheets will have a degree of curvature. Thus, the curvature of these sheets will contribute towards the end result of the this Geodesic structure more closely resembling a Dome This purpose of these Switchable photorefractive windows are to replace the need for curtains as used in conventional dwellings. All photorefractive cells would be controlled by a central voltage network; This feature will provide the occupants inside the dwelling the freedom to select the "cells" they wish to turn on to become transparent.

DETAILED DESCRIPTION OF THE INVENTION

There are two features of this invention of critical importance which need to be emphasized; Firstly, the hollow frustums are designed such that each side surface of each hollow frustum in the network of frustums will be a flush join for the entire width and length of the joining surfaces. It is essential to recognize that the superior strength of the structural assemblage is due to these flush joining side surfaces being fastened together with bolts and nuts along the entire length of the flush joining surfaces. Bolts of at least M10 will be required. But ideally M16 Bolts and nuts would be most appropriate. These bolts will protrude through holes in the side surfaces of the hollow frustums. Two bolts should be sufficient for each flush joining sides of two hollow frustums. It is suggested that a stencil be used to mark the side surfaces of the frustums where the holes are to be drilled so to ensure alignment of the holes.

Secondly, the outer edges of the resulting structural assemblage needs a protective covering and it is easy to fasten this protective covering onto the assemblage of hollow frustums because these building parts are hollow. One embodiment of this invention is a ceramic U-Bar already described. It is not essential that this protective covering or 'skin' be formed from ceramics. It could for example be formed from glass. However, this protective covering is essential; Consider the case where the structural assemblage is formed from Aluminum; a fire erupting inside the structure could collapse the structure.

Another feature of this invention critical to designing a Geodesic honeycomb skeleton capable of withstanding a severe earthquake tremor or the powerful forces impacting from a hurricane is that the designer needs to decide the number of lower levels of hollow frustums 'desired' for the formation of the structural assemblage. This number of lower levels is formation which the designer chooses based on a selection criteria and the constant $K_{nth\text{-}level}$ needing to be experimentally determined.

Given above is a formula by which the required strength of a geodesic honeycomb skeleton can be ascertained and it is repeated again below;

Overall Strength;

$$(\tau cyl)(K_{nth\text{-}level})([C_{out}^2-C_{in}^2]\pi.C_L)\geq \text{Stress needed to deform skeleton.}$$

The letter C for cylinder is used to denote the frustum because the hollow Frustums will resemble cylinders if the sides are thin enough. τcyl is the tensile strength of the frustums formed from a given material. τcyl=(τk)(τ) where τk is a proportionality constant determined by the strength of the material used for the frustums and it is suggested to assign τ as the rigidity modulus (elasticity of shear) which is the ratio of shear stress to the displacement per unit sample length (shear strain). The rigidity modulus is known for most metals and some plastics. It is suggested to assign τcyl as being the ultimate strength of the frustums measured in Newtons/(meters)$^2$.

$K_{nth\text{-}level}$ is a constant for a Geodesic Honeycomb skeleton formed from an $n_{th}$-lower level of hollow frustums where n is an integer. $K_{nth\text{-}level}$ will likely vary for Geodesic Honeycomb skeletons constructed of different materials. $K_{nth\text{-}level}$ needs to be experimentally determined for each lower level. Re-arrangement of the above formulae gives;

$$K_{nth\text{-}level}=(1/\tau cyl)*([C_{out}^2-C_{in}^2]\pi C_L)$$

If the units of τcyl are in Newtons/(meters)$^2$ then $K_{nth\text{-}level}$ will be in the same units. It is suggested that values for $K_{nth\text{-}level}$ be determined by using an applied static force in a laboratory setting and applying the force in the plane that is perpendicular to the curvature surface of the Geodesic Honeycomb Skeleton. The threshold force to deform the skeleton will be found. The constant $K_{nth\text{-}level}$ can then be determined.

Values for $K_{nth\text{-}level}$ for a Geodesic Honeycomb Skeleton of a specified diameter formed from frustums of specified dimensions could be tabulated for various lower level formations. For this tabulation only the number of lower levels in an assemblage varies with all other variables remaining constant. The designer will also need to know the magnitude of the forces which a powerful hurricane will exert to be able to design a structural assemblage of this method that can withstand these forces. But it is intuitive that the designer or Architect knows what kind of forces the skeletal assemblage needs to withstand. For this reason it is necessary to convey the relevance of $K_{nth\text{-}level}$; A Geodesic Honeycomb Skeleton formed from $2^{nd}$ lower level Hollow frustums will be a stronger skeleton than a Geodesic Honeycomb Skeleton formed from a $1^{st}$ lower level formation formed from hollow frustums of the same dimensions. And a $3^{rd}$ lower level formation will be stronger that a $2^{nd}$ lower level formation because the skeletal assemblage will be substantially reinforced. It is also necessary to consider the kinds of destructive forces that skeletal assemblage needs to endure. The destructive forces from an earthquake are different to that of the destructive force from a hurricane. The destructive forces of an earthquake is kind of vibration force. The destructive force of a hurricane is a kind of shear force. The applied static force suggested to be used in a laboratory setting to deform the structure would more closely resemble the forces from a hurricane. There will be an applied static force to deform the structure in Newtons/(meters)$^2$ that will be equivalent to the force of a wind velocity. There could be a method to measure the force that a wind velocity exerts in Newtons/(meters)$^2$. The applied static force suggested will be a TEST OF STRENGTH that would ensure that the skeletal assemblage can withstand these severe environmental forces impacting upon it.

The TEST OF STRENGTH could ensure that a Geodesic Honeycomb skeleton was the strongest structural enclosure that could be erected for a given material of given tensile strength.

Figure 14:
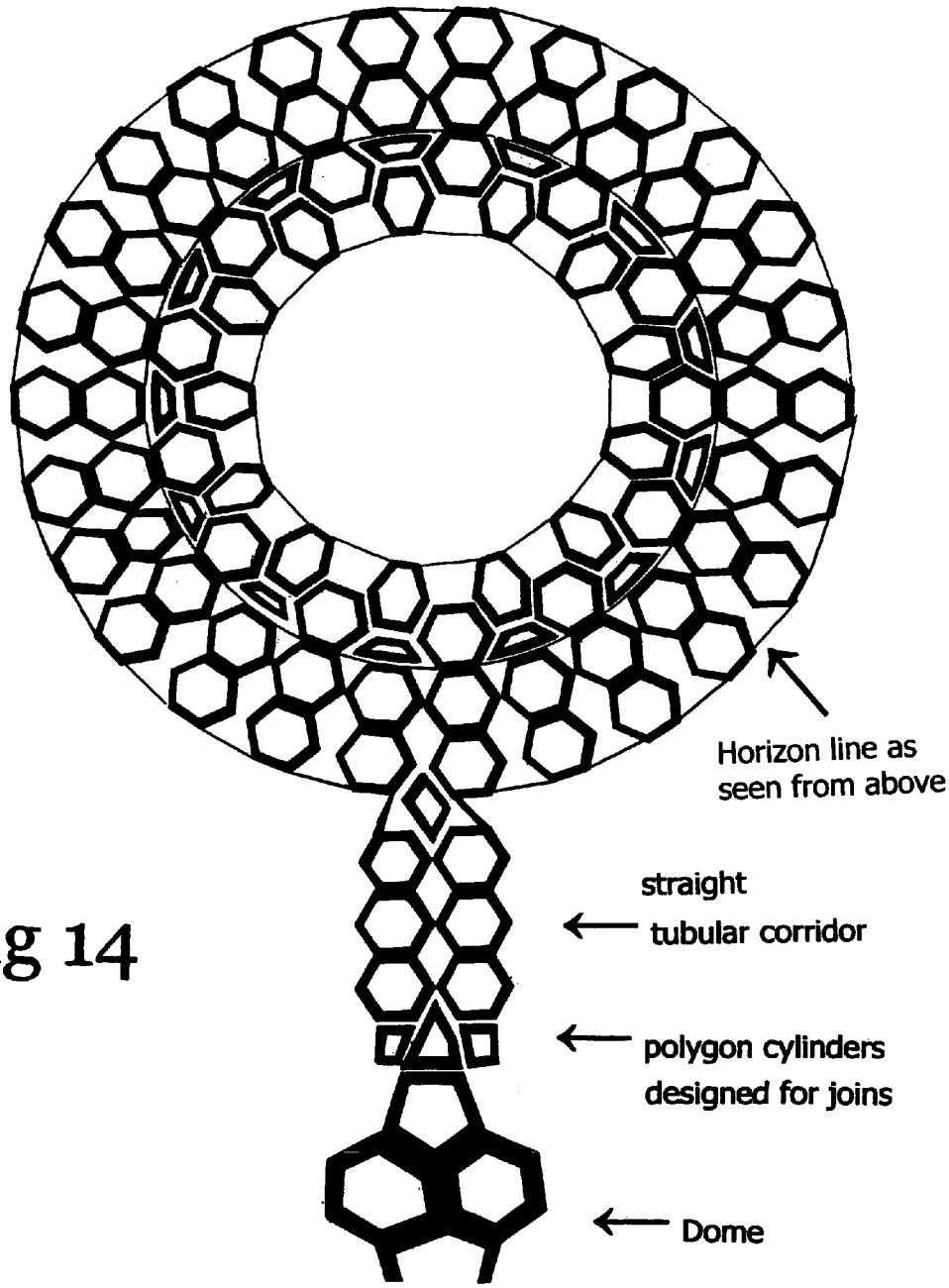
Figure 15:
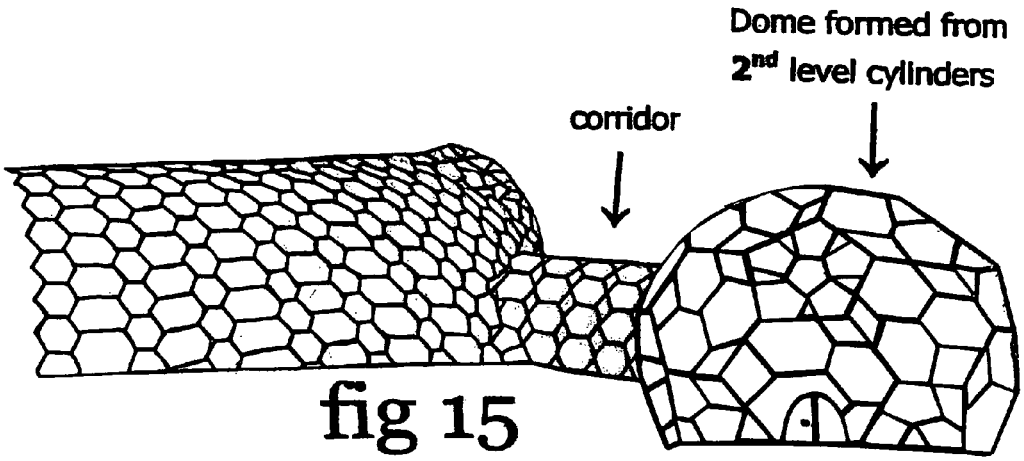
FIG. 15; the complete skeleton; a "section" of the structural continuum
Figure 17:
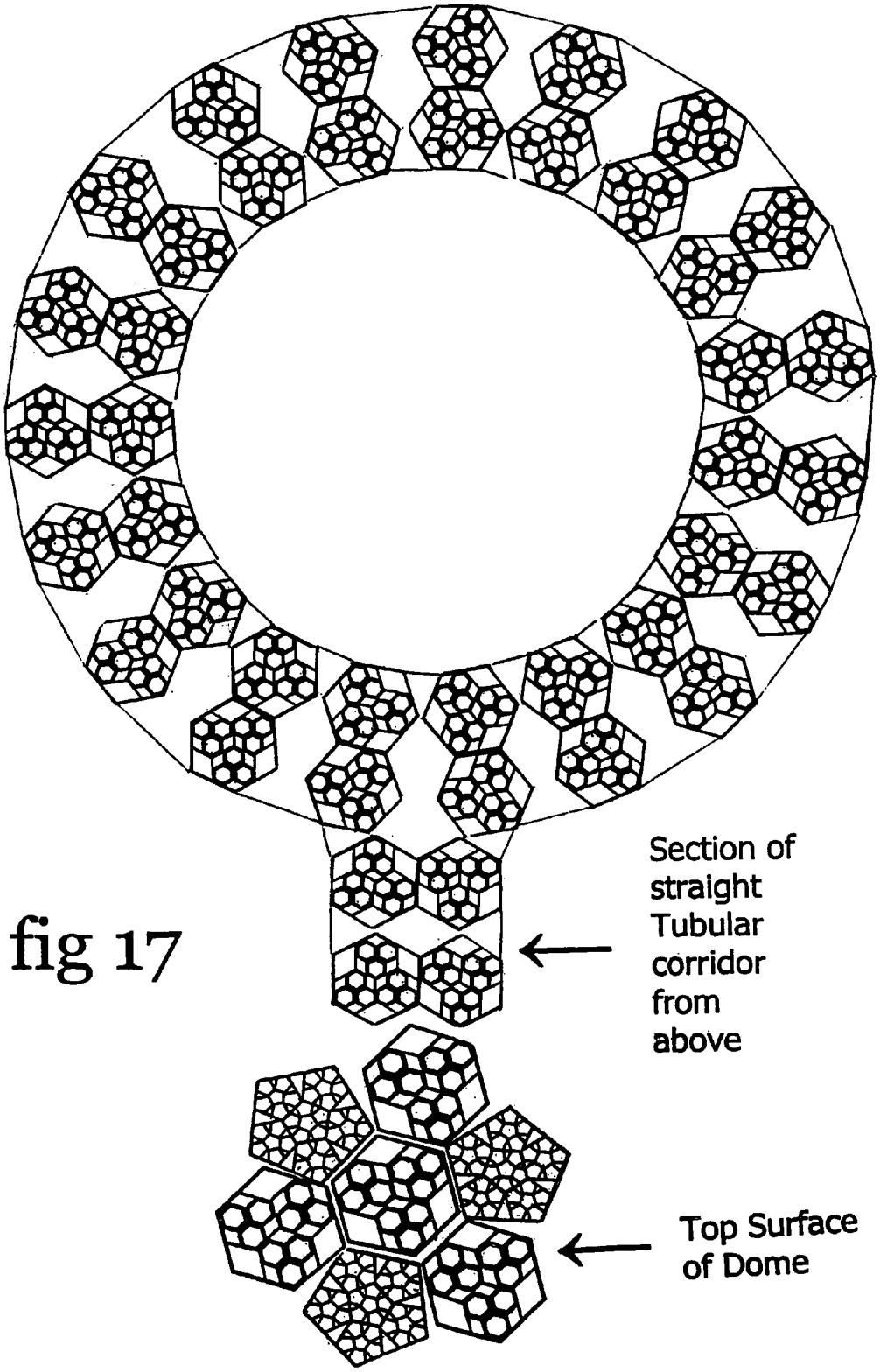

In planning for the construction of a structural continuum by the method disclosed herein, there is one aspect that needs to be stressed; the honeycomb skeleton is to be constructed from the top downwards. This is essential because the tooling to make polygon Casts for the joining cylinders need to be designed while the parts of the "prototype" skeleton are being assembled. Current methods of CAD modeling will provide a method to design the tooling without first needing to assemble parts of the skeleton, but the problem is still a complex one even using CAD. Shown in FIG. 14 are the first level hollow pyramidal frustums connected to construct a skeleton consisting of one circular tubular corridor connected to a straight tubular corridor connected to a sphere. Shown in FIG. 15 is the completed skeleton. Shown in FIG. 17 is a view looking down onto the top surface of a Dome; straight tubular corridor; section of tubular circular corridor made up of 3$^{rd}$ lower level polygon cylinders shown in FIG. 16. The detailed description of this invention is best given by the following examples;

EXAMPLE 1

A ¾ sphere is to be constructed using a Geodesic Honeycomb skeleton and is to be formed from 4$^{th}$ lower frustums (cylinders) The diameter of the ¾ sphere needs to be 14 meters at it's widest point. Also, the ratio of the volume of the interior space to the volume of the space taken up by the frustums from the entire outer periphery of the sphere must not be less than 200:1. Yet this ¾ sphere is to be as strong as possible.

a) How many hexagonal and pentagonal 4$^{th}$ lower level frustums will be required for this ¾ sphere?

b) How many triangular frustums will be needed for this ¾ sphere.

c) Determine the Angle of Taper required on the outer side surfaces of these 4$^{th}$ lower level hexagonal frustums and using this angle determine the base dimensions for the hexagonal frustums to form the Geodesic honeycomb sphere of 14 meters diameter.

d) Determine the Angle of Taper required on the outer side surfaces of the 4$^{th}$ lower level Pentagonal frustums and using this angle determine the base dimensions for the pentagonal frustums needed in the formation of this Geodesic honeycomb sphere of 14 meters diameter e) Calculate the maximum length which the frustums can be such that the ratio of the volume of interior space is not less than the required ratio of 200:1

Solutions:

a) For a ¾ sphere let $a=n_{th\text{-}level}-1$, thus a=4−1=3

Thus Σ Polygon frustums={15[3$^3$]Hex-fru.+15[6$^3$]Pent-fru}

Σ Polygon frustums=405 hexagonal frustums+2376 Pentagonal Frustums b) Each hexagonal frustum formed from one lowest level hexagonal frustums requires THREE Triangular frustums Each Pentagonal frustum formed from one lowest level Pentagonal frustums requires FIVE tri-angular frustums For a ¾ sphere formed from 4$^{th}$ lower level hexagonal and pentagonal frustums (cylinders)

$$a = 4_{th\ level-1} = 3$$

$$\Sigma Tri\text{-angular frustums } 15(3^3) + 11(5^3) = 405 + 1375$$

$$= 1780 \ \ Tri\text{-angular frustums}$$

c) For a sphere formed from 4$^{th}$ lower level frustums (cylinders)

$a=n_{th\text{-}level}$; thus a=4 the angle of taper needed for the outer side surfaces of the hexagonal frustums will be;

$$36/(2^a)=36/(2^4)=2.25 \text{ degrees}$$

The diameter of the sphere at the widest point will be 14 meters or 14,000 mm; or the radius will be 7000 mm $$\text{radius of frustums} = [\tan(2.25°)] * [7000 \text{ mm}]$$

$$= (0.0392) * [7000 \text{ mm}]$$

$$= 275 \text{ mm}$$

Thus the base diameter of the hexagonal frustums will be;

$$275 \text{ mm}*2=550 \text{ mm}$$

d) For a sphere formed from 4$^{th}$ lower level frustums (cylinders)

$a=n_{th\text{-}level}$; thus a=4 the angle of taper needed for the outer side surfaces of the pentagonal frustums will be;

$$36/(3^{4-1})*(2)=36/54=0.67 \text{ degrees}$$

The diameter of the sphere at the widest point will be 14 meters or 14,000 mm; or the radius will be 7000 mm $$\text{radius of frustums} = [\tan(0.67°)] * [7000 \text{ mm}]$$

$$= (0.0117) * [7000 \text{ mm}]$$

$$= 81 \text{ mm}$$

Thus the base diameter of the pentagonal frustums will be $$81 \text{ mm}*2=162 \text{ mm}$$

e) Volume of a sphere=$\frac{4}{3}\pi r^3$ and for this 34 sphere the volume will be $$(3/4)*(4/3)\pi r^3=\pi r^3=\pi(7 \text{ meters})^3=343\pi \text{ cubic meters}$$

The volume of this space taken up by the frustums must not exceed $1/200^{th}$ of this or 343π/200 cubic meters let Lf=length of frustums; then $\pi(Lf)^3 \leq (343\pi/200$ $$Lf=\sqrt{(343\pi)/200\pi}=\sqrt{343/200}$$

Length of frustums≤1.2 meter

EXAMPLE 2

Show by a diagram that the given formula for the angle of Taper required on lowest level pyramidal Frustums is correct for a pentagonal frustum formed from 3$^{rd}$ lower level pyramidal frustums Solution The formula for the angle of taper required on pentagonal frustums is;

$$36/(3^{a-1})*(2)$$

where a=nth lower level, and for $3^{rd}$ lower level Frustums the angle of Taper will be; $36/(3^2)*(2)=36/18=2$ degrees The assemblage has been drawn in FIG. 22*a;*
the total angle resulting from the formation of the assemblage must add to 36 degrees (as shown in FIG. 7*a*)

Figure 22A:
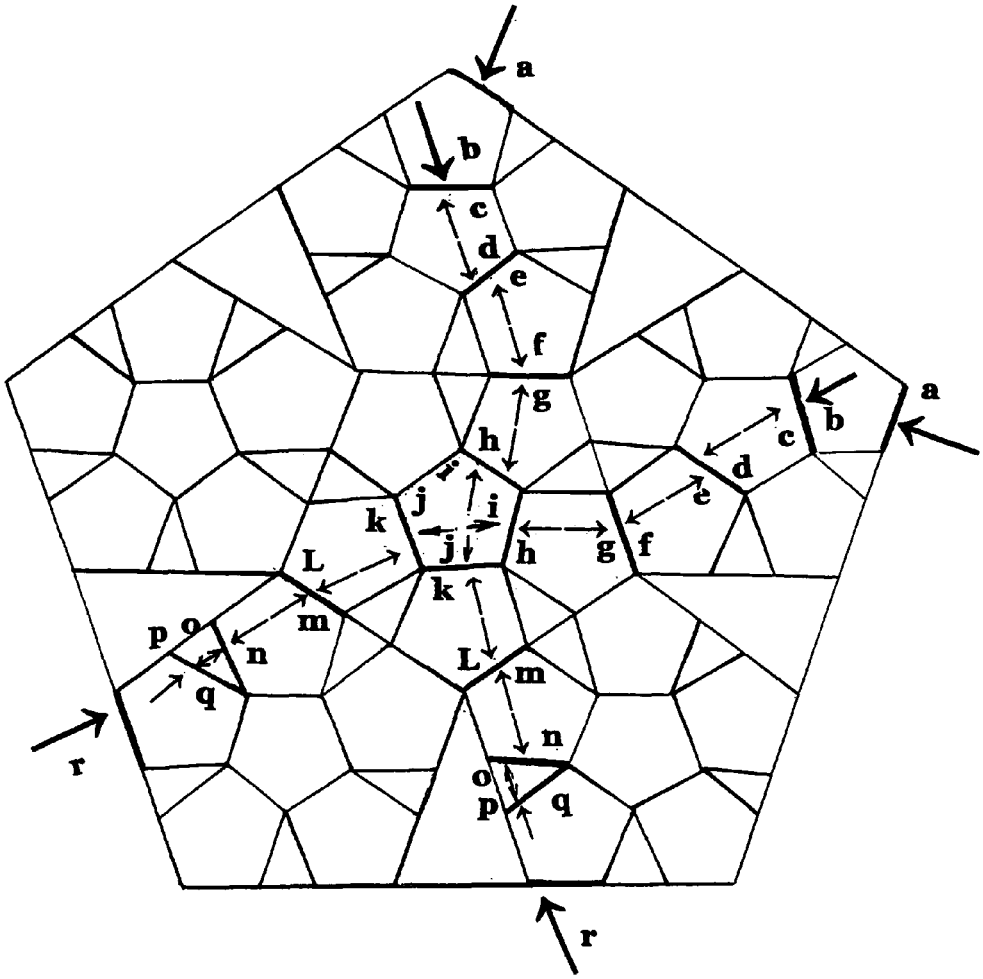

From FIG. 22*a* it can be deduced that the total number of side surfaces tracing out an angular displacement through the vertical plane of the assemblage is as follows;

One side surface at location; a; two side surfaces through bc; two surfaces through de and so on as given underneath FIG. 22*a* which results in a total of 18 tapering angles.

If the angle on each side surface of each of the joining frustums is 2 degrees as has been calculated above then the total combined angular displacement will be (2 degrees).(18) =36 degrees (which satisfies the requirement shown by FIG. 7*a*)

EXAMPLE 3

Show by a diagram that the given formula for the angle of Taper required on lowest level pyramidal Frustums is correct for an Hexagonal frustum formed from $3^{rd}$ lower level pyramidal frustums Solution The formula for the angle of taper required on Hexagonal frustums is;

$$36/(2^a)$$

where a=nth lower level, and for $3^{rd}$ lower level Frustums the angle of Taper will be; $36/(2^3)=36/8=4.5$ degrees The assemblage has been drawn in FIG. 22*b;*

The total angle resulting from the formation of the assemblage must add to 36 degrees (as shown in FIG. 7*a*)

Figure 22C:
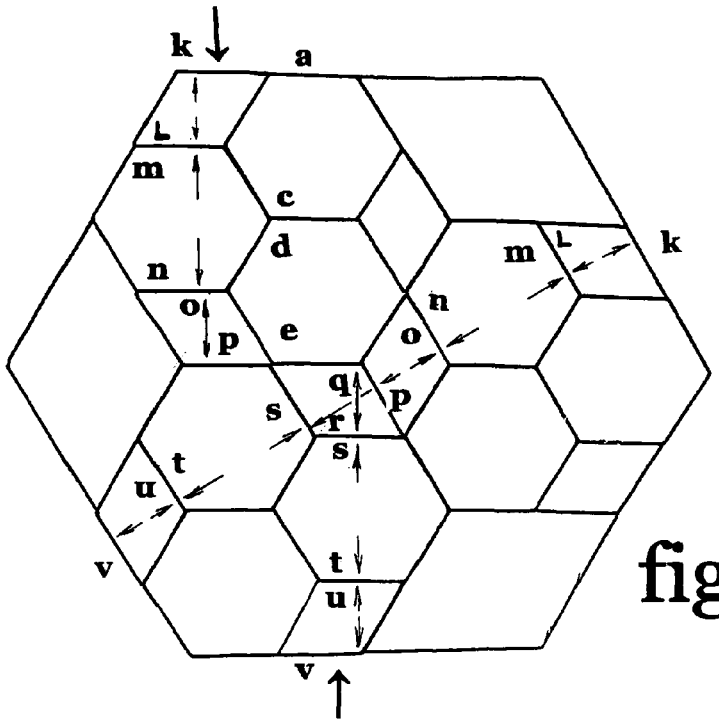
Figure 22B:
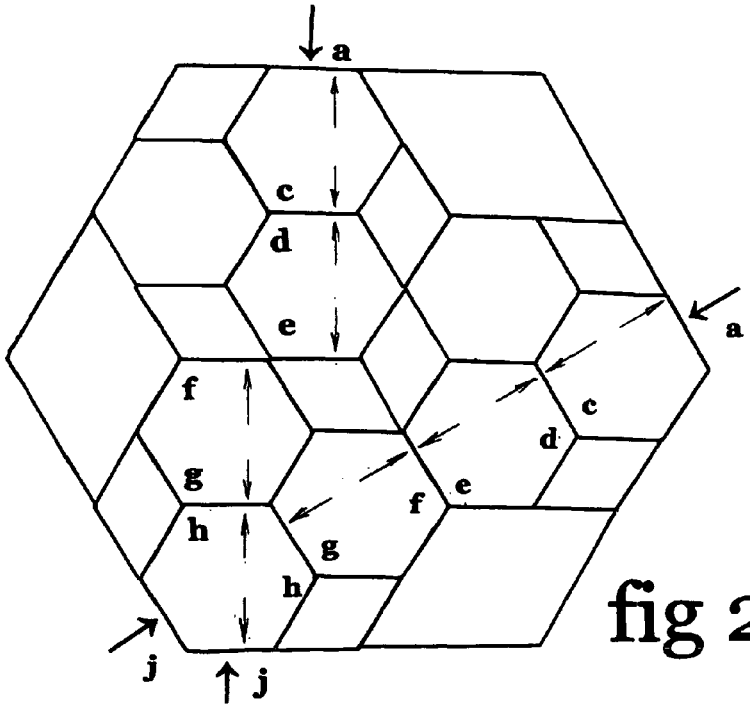

From FIG. 22*b* it can be deduced that the total number of side surfaces tracing out an angular displacement through the vertical plane of the assemblage is as follows;

One side surface at location; a; two side surfaces through cd; two surfaces through ef and so on as given underneath FIG. 22*b* which results in a total of 8 tapering angles.

If the angle on each side surface of each of the joining frustums is 4.5 degrees as has been calculated above then the total combined angular displacement will be (4.5 degrees)*(8)=36 degrees (which satisfies the requirement shown by FIG. 7*a*)

It can be seen from FIG. 22*b* that the angle of taper required on the Rhombi pyramidal frustums will be slightly less than that required on the hexagonal pyramidal frustums.

A line from side surface k to side surface p as shown on FIG. 22*c* indicates a total of 6 side surfaces compared to 4 side surfaces for a line from a through to e Thus, the angle of taper required on the side surfaces of the Rhombi frustums can be found by adding up the angles from the planes of side surfaces k through to V as shown on FIG. 22*c.*

The total of the angles must add to 36 degrees.

From FIG. 22*c* the collection of angles beginning at side surface k and terminating at side surface V is as follows
y=angle of taper on Rhombi frustums;

$$\{y+y+4.5++4.5+y+y\}+\{y+y+4.5++4.5+y+y\}=36 \text{ degrees}$$

$$8y+18=36 \text{ thus, } y=2.25 \text{ degrees}$$

EXAMPLE 4

A ¾ sphere is required to be constructed using a Geodesic honeycomb skeleton and it is desired that the spherical formation be constructed from $5^{th}$ lower level Pyramidal Frustums such that the outer surface of the sphere will serve as a display screen.

A sheet of OLED (Organic Light Emitting Diode) will be inserted into each Frustum so each frustum will be one Pixel in the Spherical display screen. The size of each Pixel (and thus the diameter of each frustum) is to be approximately 200 mm.

a) Draw front views of the Pentagonal and Hexagonal Frustums formed from $5^{th}$ Level Frustums and indicate with Bold outlines on each drawing; the boundaries of each of the lower levels within the formation of;
   the Pentagonal Frustums and
   the hexagonal Frustums
b) Calculate the resulting Diameter of the sphere for this size of elemental Frustum of which the Geodesic Honeycomb skeleton comprises.
c) Determine the diameter of the inner base of the Hexagonal Frustum if the length of the frustum is to be 600 mm
d) Produce drawings of the frustums showing a ledge around the outer base periphery of each frustum which the sheet OLED material will sit within.

Figure 23A:
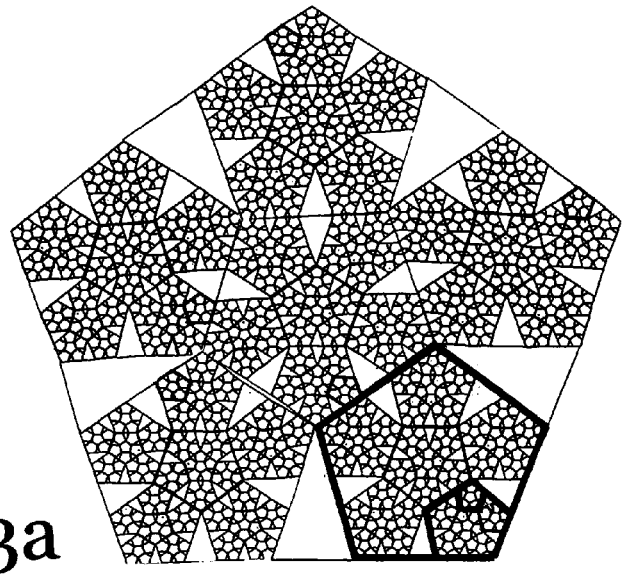
Figure 23B:
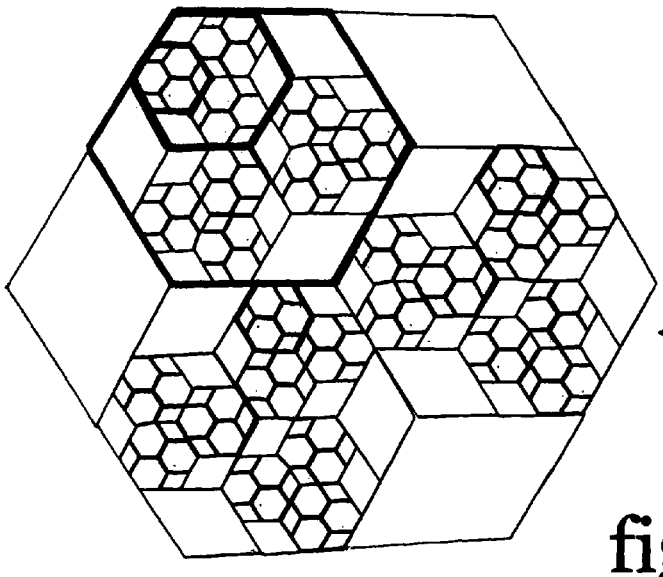
Figure 23D:
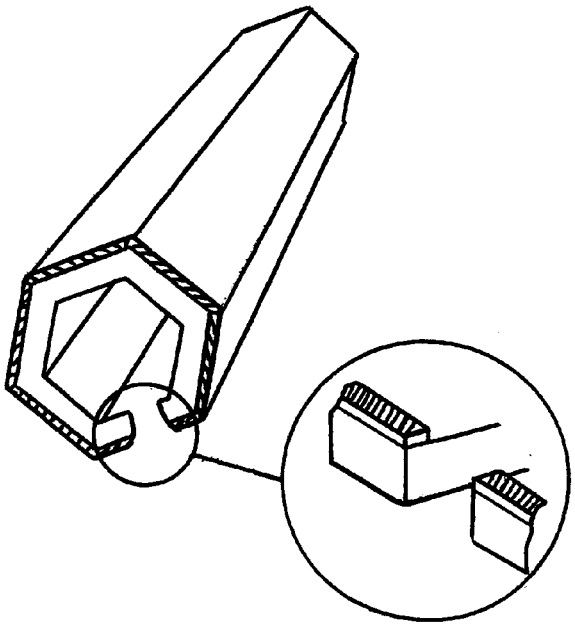
Figure 23C:
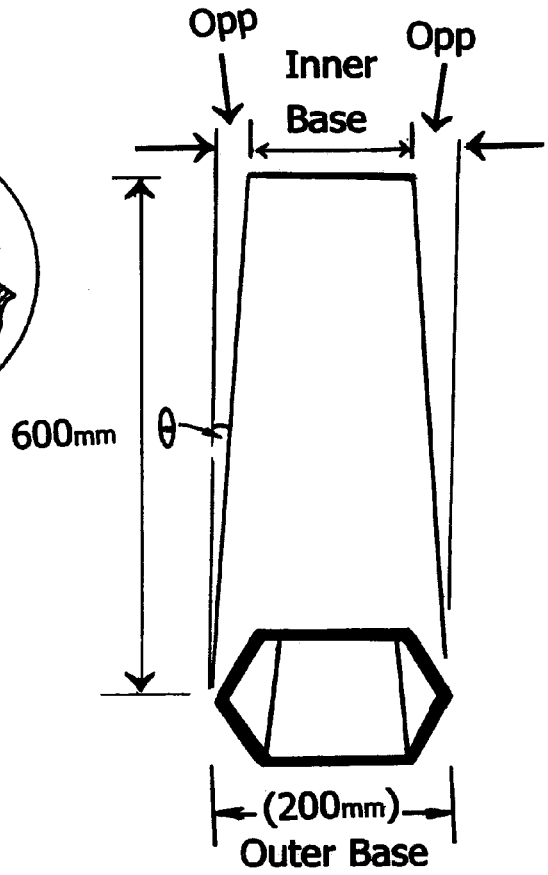

Solution;

a) The drawings are shown in FIGS. 23*a* and 23*b*
b) From FIG. 23*b* it can be deduced that for $5^{th}$ lower level frustums of 200 mm from side edge to side edge, the diameter of the largest level hexagonal frustum will be $$(0.2 \text{ meters}*4)*4=3.2 \text{ meters}$$

$$\text{Diameter of sphere is then} = \{3.2 \text{ meters}/\text{Tan}(18°)\}*2$$
$$\{3.2 \text{ meters}/0.325\}*2$$
$$= 19.7 \text{ meters}$$

c) From FIG. 23*c;*

$$\text{Diameter of Inner Base}=\{200 \text{ mm}\}-2*\{\text{Opp}\}$$

Figure 23E:
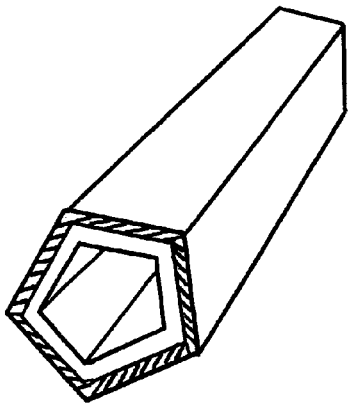

Opp/600 mm=Tan(θ) and for $5^{th}$ lower level frustums $$\theta=36/2^a=1.12 \text{ degrees (where } a=5)$$

$$\text{Diameter of Inner Base}=\{200 \text{ mm}\}-2*\{600 \text{ mm}*(\text{Tan}(1.12°)\}$$

$$\text{Diameter of Inner Base}=200 \text{ mm}-24 \text{ mm}=176 \text{ mm}$$

d) Drawings are shown in FIG. 23*d* and FIG. 23*e*

EXAMPLE 5

A ¾ sphere is required to be constructed using a Geodesic honeycomb skeleton and it is desired that the spherical formation be constructed from $3^{rd}$ lower level pyramidal Frustums that will be connected to a honeycomb tubular corridor also constructed from $3^{rd}$ lower level Hexagonal pyramidal Frustums.

The sphere is to be approximately 10 metres in diameter and the tubular corridor is to be approximately half this diameter.

a) Show a view from the top of the sphere joined to the straight tubular corridor.

b) Calculate the required diameter of the elemental hexagonal and pentagonal Frustums for the sphere c) Produce a drawing that can be cut-out and folded to form a ¾ sphere that shows a formation from $3^{rd}$ lower level frustums d) Starting with a drawing of ¾ sphere formed from a $2^{nd}$ lower level formation produce a drawing of a ¾ sphere showing a $3^{rd}$ lower level formation Solution;

a) Drawing is shown in FIG. 24 b) For $3^{rd}$ lower level hexagonal frustums the angle of taper on the side surfaces of the frustums will be;

$$36/2^{a}=36/8=4.5 \text{ degrees (where } a=3)$$

$$\text{Diameter of sphere}=10 \text{ metres}=2*\{\text{Radius-fru/Tan } 4.5°\}$$

$$\text{Radius-fru}=(10/2)*\text{Tan } 4.5°=5*\text{Tan } 4.5°=0.4 \text{ metres}$$

Thus, diameter of hexagonal frustums will be 0.8 m=800 mm

For $3^{rd}$ lower level Pentagonal frustums the angle of taper on the side surfaces of the frustums will be;

$$36/\{3^{a-1}*2\}=36/18=2 \text{ degrees (where } a=3)$$

$$\text{Diameter of sphere}=10 \text{ metres}=2*\{\text{Radius-fru/Tan } 2°\}$$

$$\text{Radius-Cyl}=(10/2)*\text{Tan } 2°=5*\text{Tan } 2°=0.17 \text{ meters}$$

Figure 25:
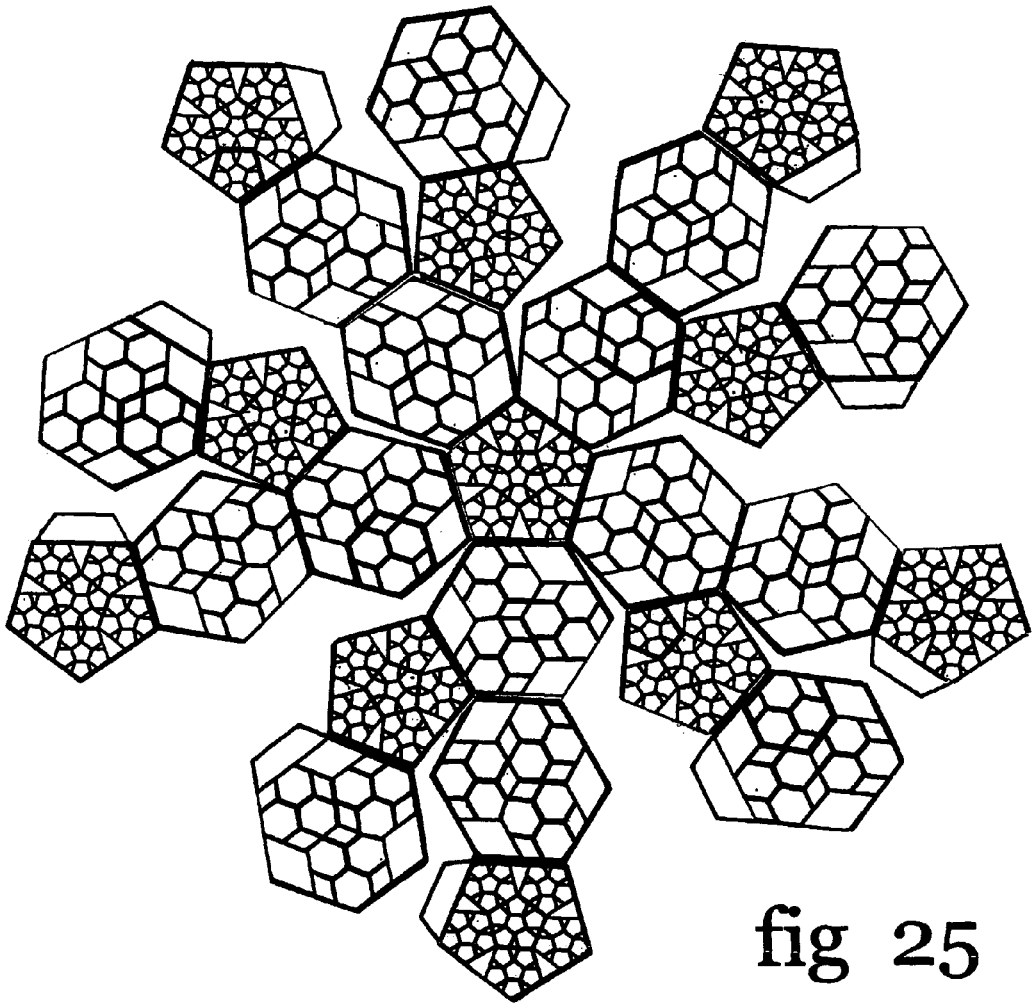

Thus, diameter of Pentagonal frustums will be 0.35 m=350 mm c) Drawing shown in FIG. 25 e) Drawings shown in FIG. 26*a* and FIG. 26*b*.

a view from above the ¾ sphere looking downward at a 45° angle is shown in FIG. 26*b*

COMMENT and OBSERVATION; In this example it was desired that the spherical formation be constructed from $3^{rd}$ lower level pyramidal. frustums. It needs to be stressed that the choice of nth lower level formation is that which the designer will choose and partly based upon environmental conditions which his/her Geodesic Honeycomb building will need to withstand.

The design selection which the designer would be based upon the testing of geodesic honeycomb spheres placed directly in the path of a tornado. Spheres of the same size and comprising the same skeletal material and only differing in their nth lower level formation could be accessed in this extremely harsh conditions.

It is intuitive that a lower level geodesic formation will be strongest but it's complexity is substantially increased

EXAMPLE 6

Return to Example 3 which involved the design of a geodesic honeycomb sphere formed from $5^{th}$ lower level pyramidal frustums It is seen that for this sphere which incorporates a display screen on the outer surface; that the $1^{st}$ level Pentagonal frustums contain a higher resolution pixel count than the $1^{st}$ level hexagonal frustums. It is required to solve this imbalance.

A solution to the problem of increasing the pixel density can be solved by designing conglomerates of lower level frustums to fit inside each hexagonal frustum in the network and in this case it is decided that conglomerates of $2^{nd}$ lower level frustums be designed and manufactured to increase the pixel count and thus the resolution of the hexagonal frustums Design a conglomerate of $2^{nd}$ lower level hexagonal cylinders to fit inside each $5^{th}$ lower level Hexagonal pyramidal frustum.

Take the thickness at the outer Base of the frustums to be 20 mm.

Solution

From Example 6 the outer diameter of the frustums at the widest point will is 200 mm and taking the thickness at the outer base of the frustum is 20 mm. Thus, the widest dimension of the interior walls of the frustum will be 160 mm which is shown as shown on FIG. 27*a*.

It is also necessary to be aware that the interior walls of the hexagonal frustums will not taper. These interior walls will be completely perpendicular to the plane of the outer base of the frustum. Thus, the conglomerates will be formed from cylinders.

For a hexagon of side length t, the minimal diameter is $t.\sqrt{3}$

The maximum diameter will be 2.t

The Area of a regular hexagon is; Area=$\frac{1}{2}\{3.\sqrt{3}\}t^2$

From FIG. 27*a*; w=minimal with of elemental Hexagonal cylinder in conglomerate is $$w=t.\tfrac{1}{2}\sqrt{3}$$

If s=length of the sides of the elemental hexagons forming the conglomerate, then s in terms of t can be found;

$$w=s\sqrt{3}=\tfrac{1}{2}.t.\sqrt{3} \text{ (as shown in FIG. } \mathbf{27}b)$$

Thus s=½t

Thus, the length s of the sides of the hexagon cylinders forming the conglomerate will be half the length of a side of an interior wall of the $5^{th}$ lower level frustum.

2t=160 mm, thus t=80 mm and thus s=40 mm

The conglomerate will be formed from three hexagonal cylinders having sides of length 40 mm. to allow some clearance to enable the conglomerate to be pushed inside the frustum it is best to choose 39 mm as the dimension for the sides of the hexagonal cylinder

EXAMPLE 7

A Geodesic honeycomb tubular corridor is to be designed that will be approximately 20 metres in diameter measured from opposite ends of the round path length.

The cross section of this circular tubular corridor will be a semi-circle from the highest point to the ground. The width/diameter of this semi-circular tubular corridor is to be approximately 4 metres and it is to be formed from $1^{st}$ level Hexagonal frustums (cylinders) These Hexagonal frustums are to have a minimal diameter of approximately 350 mm.

a) Design all hexagonal and polygonal frustums that will be needed to construct this Geodesic Honeycomb circular corridor. Provide all dimensions on drawings. Develop any formulas that could assist with calculating dimensions required for the design.

b) Provide an outline of the steps required to calculate the dimensions for the frustums. These steps should be such that a C++ program can be written to calculate the dimensions of all frustums based on a specified design criteria.

c) Produce drawings of the circular tubular corridor connected to a straight tubular corridor which is connected to a sphere Solution These frustums will be designed so that these building blocks, being assembled around a line of the circumference are all the same size as shown in FIG. 11. The Rhombic frustums needed in the spaces will vary in size.

The circumference of a circle=π.D and for this tubular corridor the arc length of the semi-circular circumference will be; ½.π. (4000 mm)=π. (2000 mm) and the minimal diameter of the hexagonal frustums is to be approx 350 mm Thus, the number of Hexagonal frustums required for the formation of a single line of the circumference will be;

$$\pi.\ (2000\ \text{mm})/350\ \text{mm}=18\ \text{frustums}$$

It is absolutely essential that an even number of frustums be used.

Because the round path length (RPL) should be the join situated in the centre of the corridor. Otherwise the calculations become unnecessarily complicated and this example cannot be followed as a method.

The problem is now of determining the angle of Taper required on two of the six side surfaces of the frustum. Shown in FIG. 11 and also FIG. 28*b* are the six sides which are labeled.

The angle of taper required on sides 2 and 5 are required for the formation of the semi-circular arc of the tubular corridor. From FIG. 28*a* it is seen that a total of 36 side surfaces contribute to the formation of the 180 degree arc. (2 side surfaces at each join) Thus, the angle of taper required on sides 2 and 5 of each cylinder will be;

$$180\ \text{degrees}/36=5\ \text{degrees}$$

The angle of Taper required on sides 1; 3; 4; 6 will be discussed towards the end of this solution.

Polygonal frustums to be fitted in between the lines of hexagonal frustums (as shown in FIG. 11) will now need to be designed. The problem is somewhat involved because the dimensions of each one of these polygonal frustums assembled along a line of the circumference will be different.

I now proceed to show a method by which these dimensions can be calculated.

It is seen from FIG. 11 that the space between the joining lines of hexagon Frustums will increase as the line moves from the inner horizon to the outer horizon.

Figures 28D, 28E:
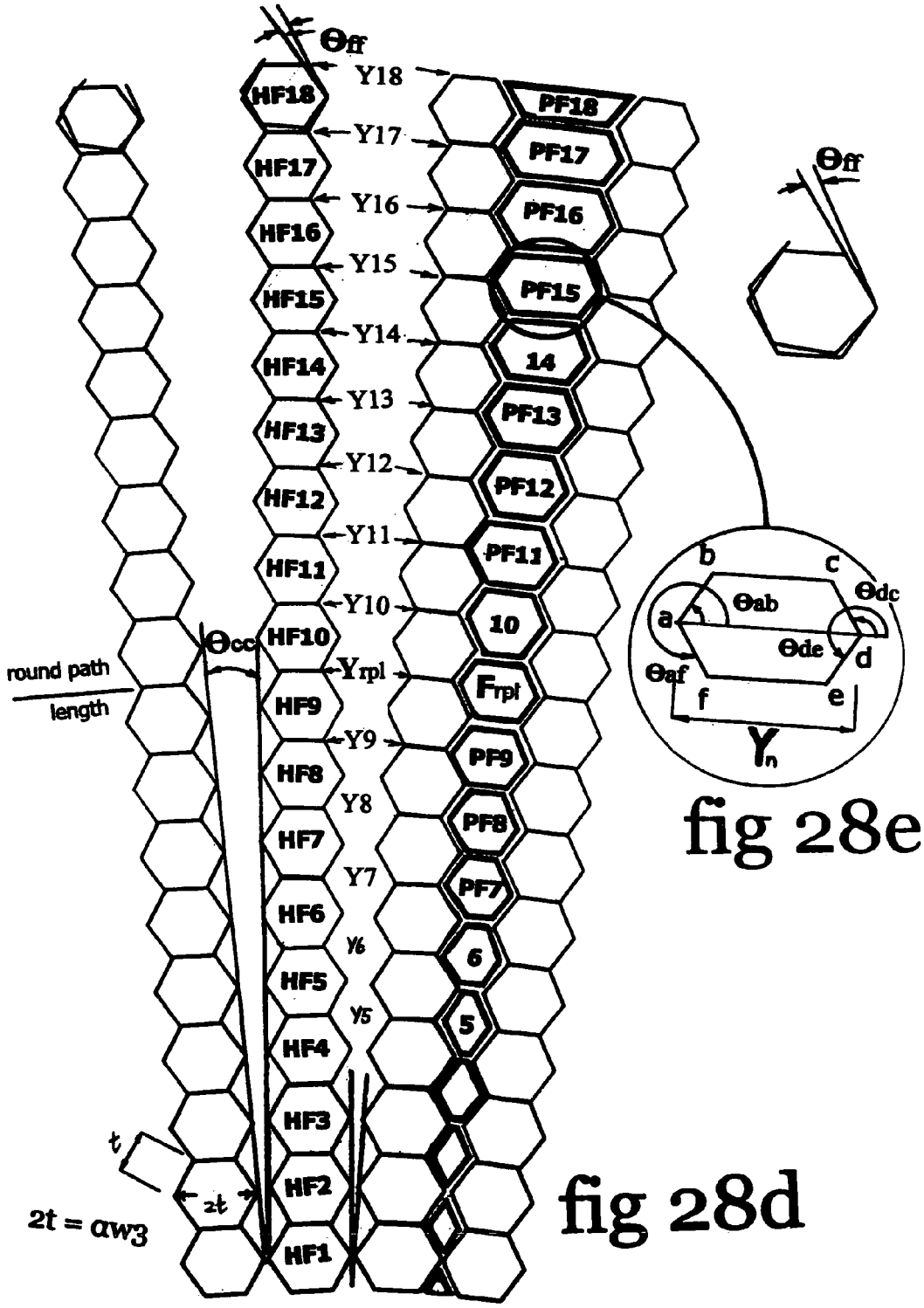

To design the polygon frustums to fit into these spaces it is necessary to determine Y1; Y2; Y3; Y4; up to Y18 as indicated on FIGS. 28*b* and 28*d*. Once these distances are found then it is straightforward to calculate the dimensions of the polygon frustums; PF1; PF2; PF3; up to PF18 as shown in FIG. 28*d*.

First it is required to calculate distances L1 to L9 shown in FIG. 28*c*. These distances will be needed in an equation to calculate Y1; Y2; Y3; Y4; up to Y18.

L1 to L18 are distances to be used as radial distances but it is essential to keep in mind that when calculating Y1; Y2; Y3; Y4; up to Y18 the circumferences at distances L1 to L18 will be $\pi$.D The diameter of the tubular corridor from furthest points on the round path length (centre of the corridor) is 20 metres. The corridor is 4 meters wide, thus it's radius is 2 metres; Thus the diameter between furthest points on the inner horizon will be;

$$20\ \text{metres}-(2\ \text{metres}\times 2)=16\ \text{metres}$$

The radius of the inner horizon L1 is then =8 metres

I designate the distances; $\alpha w1+\alpha w2+\alpha w3$ $\alpha w1$ is the minimal width of the hexagonal frustum and $\alpha w2$ is half the minimal width of the hexagonal frustum.

$\alpha w3$ is the maximal width of the frustums

In this example;

$\alpha w1=0.35$ metres $\alpha w2=0.175$ metres

From Example 6 the maximal width of a hexagon is 2.t and the minimal width is $t.\sqrt{3}$ where t=length of a side.

In this example $t.\sqrt{3}=0.35$ and thus the maximal width $2.t=2.(0.35\ \text{mm})/\sqrt{3}$ Or;

$$2t=0.7\ \text{metres}/\sqrt{3}=0.404\ \text{metres}=\text{maximal width of frustums}$$

$\alpha w3$=Maximal width of frustums=404 mm=0.404 metres

The calculation of distances L1 to L18 is somewhat involved because it must be keep in mind that these distances form an arc From FIG. 28*c* it can is seen that there is a total of 10 joining surfaces between frustums, including the ground, to form the arc from 0° to 90° so that θ will increase by 9°

$$\Delta w1=H.(\sin\theta 1)$$

In this example H=350 mm

From diagram 28*c;*

$\Delta$w1=350. sin(9°) metres=55 mm $\Delta$w2=350. sin(18°) metres=108 mm $\Delta$w3=350. sin(27°) metres=159 mm $\Delta$w4=350. sin(36°) metres=206 mm and continuing for distances; $\Delta$w5 to $\Delta$w9

$\Delta$w5=247 mm $\Delta$w6=283 mm $\Delta$w7=311 mm $\Delta$w8=332 mm $\Delta$w9=345 mm L1=8 meters L2=L1+($\Delta$w1)

L3=L1+($\Delta$w1+$\Delta$w2)

L4=L1+($\Delta$w1+$\Delta$w2+$\Delta$w3)

L5=L1+($\Delta$w1+$\Delta$w2+$\Delta$w3+$\Delta$w4)

L6=L1+($\Delta$w1+$\Delta$w2+$\Delta$w3+$\Delta$w4+$\Delta$w5)

for L2 to L9 Ln=[8+$\Sigma$($\Delta$w1+ . . . +$\Delta$wn−1)]

Lrpl (at round path length)=L1+2 metres=10 metres

L10=Lrpl+2.($\Delta$w9)

L11=Lrpl+2.($\Delta$w9+$\Delta$w8)

L12=Lrpl+2.($\Delta$w9+$\Delta$w8+$\Delta$w7)

L13=Lrpl+2.($\Delta$w9+$\Delta$w8+$\Delta$w7+$\Delta$w6)

for L10 to L18 Ln=[10+$\Sigma$($\Delta$w9+ . . . +$\Delta$w[19−(n)]]

The values for L2 to L18 are tabulated below;

L1=8 metres L2=8.055 metres L3=8.16

L4=8.33 L5=8.53 L6=8.77

L7=9.06 L8=9.37 L9=9.70

Lrpc (at round path length)=10 metres

L10=10.34 L11=10.67 L12=11

L13=11.30 L14=11.50 L15=11.70

L16=11.85 L17=11.95 L18=12 metres

From FIG. 11 it cannot be seen that all the frustums are touching at the maximal width along the inner horizon of the corridor. However, these frustums will infact be touching.

The number of hexagonal Frustums around full circle of corridor at the inner horizon, and thus the number of lines of hexagonal frustums around the full circle of the corridor can now found;

Number of Frustums $2\pi r/\alpha w3$ where $r=8+\alpha w2$ $$\text{Number of Frustums}=2\pi\cdot(8+0.175)/0.404\ \text{meters}$$

$$=127$$

The number of lines of hexagonal frustums around the full circle of the corridor will now be referred to as the; Fnumber $$Fnumber=\frac{2\pi\left(\begin{array}{c}\text{radius at first point of maximal}\\ \text{width of hexagons past inner horizon}\end{array}\right)}{(\text{maximal diameter of frustums})}$$

Now that the Fnumber has been established and the distances L1; L2; L3; L4; L5; L6; L7; L8; L9 have been calculated then the distances Y1; Y2; Y3; Y4; up to Y18 can be calculated.

$$Y2 = \frac{\text{Circumference of line passing through } Y2}{\{(Fnumber)\cdot(\alpha w_3)\} + (\text{number of spaces})}$$

In general;

$$Yn = \frac{2\cdot(\text{Ln})\pi}{(Fnumber)\cdot\{\alpha w_3 + 1\}}$$

In this example the Fnumber as calculated from the above equation =127

$$Y2 = \frac{(L2)\cdot 2\pi}{127\{0.404+1\}}$$

$$Y3 = \frac{(L3)2\cdot\pi}{127\{0.404+1\}}$$

$$Y4 = \frac{(L4)2\cdot\pi}{127\{0.404+1\}}$$

and continuing on to find distances up to Y18

The results are as follows;

Y1=282 mm Y2=284 mm Y3=287 mm
Y4=297 mm Y5=300 mm Y6=310 mm
Y7=322 mm Y8=330 mm Y9=341 mm
Yrpl=2π(10 metres)/127(1.404)=0.35 metres
Y10=364 mm Y11=376 mm Y12=387 mm
Y13=398 mm Y14=405 mm Y15=412 mm
Y16=417 mm Y17=421 mm
Y18=(11.65 metres).2π/127{0.404+1}=423 mm Now that these distances have been found the polygonal frustums can be designed.

There are only four sides of each of these polygonal frustums that need to be calculated and these sides can be calculated as vectors The length of these vectors will all be the same length; the length of the sides of the hexagonal frustums.

The maximal diameter of the of the hexagonal frustums;

$t.\sqrt{3}$=350 mm where $t$ is the length of the sides $t$=350 mm/√3=202 mm

Figure 28F:
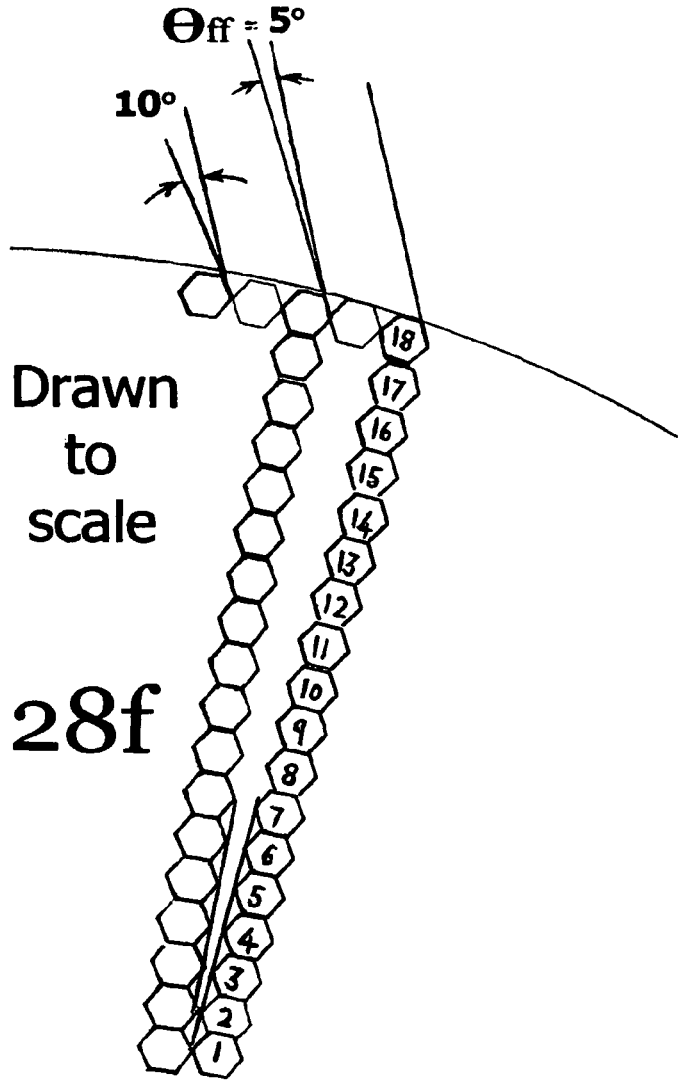

Shown in FIG. 28*f* is a polygonal frustum formed from vectors ab; cd; de; fa and the lengths will all be 202 mm for every polygonal frustum needed.

The angles for each of these vectors for each of the 18 polygonal frustums are as follows;

From diagram 28*e;*

$ab$=202/60°+(offset angle)

$dc$=202/120°−(offset angle)

$de$=202/240°−(offset angle)

$ef$=202/300°+(offset angle)

The offset angle will be designated θff and the problem is now of ascertaining θff Referring to FIG. 28*d;*

Y18=0.41 meters

The angle θcc is the diverging angle along the line of the semi-circular circumference;

The length of the side adjacent θcc is the width of the semi-circular circumference which in this example is; 4 meters−αw2=3.82 metres From FIG. 28*d* the width of the side opposite θcc is the line located αw2 above Y18 between maximal widths of the hexagons; this width will be Y18/2=0.2 metres approximately;

$\theta cc$=[arcsin {0.2/3.82}]=3 degrees

This offset angle θff is a displacement angle and from FIG. 28*d* the hexagons along the outer periphery can be looked upon as being displaced through the angle of θcc which in this example is found to be 3 degrees. This equates to a distance along the outer periphery of; {(3)/(360°)}.24π=0.630 meters=which would appear correct considering the distance Y18=0.41 metres (Note that in FIG. 28*d* θcc has been increased so that the drawing can provide better clarity)

θff is related to the rate of change of curvature; the rate that a tangential line changes as it moves along the curvature of the outer circle. It is easy to see that as the circle becomes smaller or the hexagons become larger the rate of change of the Tangential line and also θff will become greater. From Calculus, the rate of increase of an angle ψ to an arc length s defines the curvature;

$$\kappa = \frac{d\psi}{ds}$$

θff will be equal to the change in the tangential angle ψ as the tangent moves around the outer periphery of a circle for a distance that's equivalent for one outer hexagon to superimpose onto a neighboring outer hexagon.

θff will be estimated from a drawing of the curvature of the outer periphery and drawings of hexagons drawn to scale.

This drawing is FIG. 28*f* and uses a ratio of the curvature to the maximal width of the hexagons that's very close to scale.

In this example the ratio of the radius of the corridor to the maximal width of the frustums is; 12 metres/0.404 metres=29.7

The curve in FIG. 28*f* has a radius of 178 mm

The hexagons have a maximal diameter of 6 mm

The ratio is; 178 mm/6 mm=29.6

From FIG. 28*f* θff is estimated to be =5°±1°

The effect of θff will be negligible and could be neglected in the case where thick gasket sheet is to be deployed between side joining surfaces of the frustums.

θff will be included into calculations for the polygonal frustums.

Tabulated values for θff are as follows

θff is approximately 5 degrees at the outer periphery,

For PF18; θff=(5°)
For PF17; θff=17/18(5)=4.7°
For PF16; θff=16/18(5)=4.4°
For PF15; θff=15/18(5)=4.2°
For PF14; θff=14/18(5)=3.9°
For PF13; θff=13/18(5)=3.6°
For PF12; θff=12/18(5)=3.3°
For PF11; θff=11/18(5)=3°
For PF10; θff.=10/18(5)=2.8°
For PF9; θff.=9/18(5)=2.5°
For PF8; θff.=8/18(5)=2.2°
For PF7; θff.=7/18(5)=1.94°
For PF6; θff.=6/18(5)=1.6°
For PF5; θff.=5/18(5)=1.4°
For PF4; θff.=4/18(5)=1.1°
For PF3; θff.=3/18(5)=0.8°
For PF2; θff.=2/18(5)=0.5°
For PF1; θff.=1/18(5)=0.3°

Figure 28G:
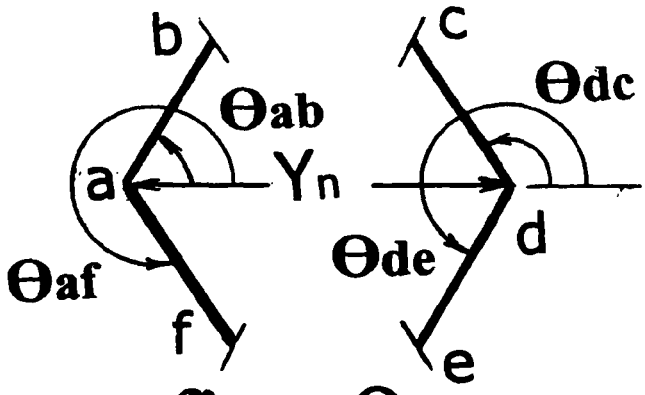

The designs for all 18 polygonal frustums are shown in FIG. 28*g*. For all these frustums the only change in dimension is the length Y.

All side surfaces 1; 3; 4; and 6 require no angle of taper; These side surfaces are 90° perpendicular to the plane of the frustum.

Side surfaces 2 and 5 will require the same angle of Taper as for the hexagonal frustums which in this example is 5°

All side angles ab; dc; de; ef are represented as vectors with dimensions as follows;

$$ab=202/60°+(\theta ff)$$

$$dc=202/120°-(\theta ff)$$

$$de=202/240°-(\theta ff)$$

$$ef=202/300°+(\theta ff)$$

All polygonal frustums are described using the format shown in FIG. 28*f*.

Angle of Taper Required on Side Surfaces

As previously stated the angle of taper required on side surfaces 2 and 5 will be 5 degrees. the angle of taper required on side surfaces 1; 3; 4; 6 will be;

$$\frac{360 \text{ degrees}}{2\cdot\{Fnumber\}} = \frac{360}{(2)(127)} = 1.4 \text{ degrees}$$

Which is very negligible. It is suggested that there be no angle of taper on side surfaces 1; 3; 4; 6

Instead, a 20 mm wide strip of cloth tape or gasket material can be wrapped around the front side circumference of the Frustums.

This tape would need to be between 1 mm to 3 mm thick.

All the necessary information has been compiled to provide measurements for all of the Polygonal frustums required for the circular tubular honeycomb corridor of this example Dimensions for six of the 19 different polygonal frustums are given below PF18; Distance Y18=423 mm $$ab=202/60°+5° \quad dc=202/120°-5°$$

$$de=202/240°-5° \quad ef=202/300°+5°$$

PF17; Distance Y17=421 mm $$ab=202/60°+4.7°) \quad dc=202/120°-(4.7°)$$

$$de=202/240°-(4.7°) \quad ef=202/300°+(4.7°)$$

PF16; Distance Y16=417 mm $$ab=202/60°+4.4°) \quad dc=202/120°-(4.4°)$$

$$de=202/240°-(4.4°) \quad ef=202/300°+(4.4°)$$

PF15; Distance Y15=412 mm $$ab=202/60°+4.2°) \quad dc=202/120°-(4.2°)$$

$$de=202/240°-(4.2°) \quad ef=202/300°+(4.2°)$$

PF14; Distance Y14=405 mm $$ab=202/60°+3.9°) \quad dc=202/120°-(3.9°)$$

$$de=202/240°-(3.9°) \quad ef=202/300°+(3.9°)$$

PF13; Distance Y13=398 mm $$ab=202/60°+3.6°) \quad dc=202/120°-(3.6°)$$

$$de=202/240°-(3.6°) \quad ef=202/300°+(3.6°)$$

Steps are now provided to calculate the Y dimension for the Polygon Frustums based on a specified design. These are steps needed to be followed to create a C++ program that will perform all calculations.

STEP 1; Designer must determine the number of frustums that will be assembled to form the semi-circular arc length of the corridor This number MUST be an even number STEP 2; Program will request Number of hexagonal frustums to form semi-circular width.

Program will designate this number HF and print this number to the screen

Program will divide HF by 2 and designate this number HF2

Program will request minimal width of frustums

Program will designate; αw1 to this width

Program will designate; αw2=(αw1)/2

Program will designate; αw3=[(2)*(αw1)]/√3

Program will print these values to the screen

Program will request the width of the corridor.

Program will designate this value Cw and print this to the screen

Step 3

Program will request the diameter from opposite ends of the round path length.

Program will designate this value Drpl and print this to the screen

Program will designate Lrpl (Lrpl=Drpl/2) and print this value to the screen.

Program will designate θ° (θ=Cw/HF) and print θ to the screen

Program will calculate values for Δw1 to ΔwHF using Δwn=αw1.(sin nθ) for n=1 to n=HF2

Program will print these values to the screen

Step 4

Program will designate L1; L1=Drpl−(Cw*2)

Program will print this value to the screen

Program will calculate values for Ln where $$Ln=Ln-1+\Delta wn \text{ for } n=2 \text{ to } n=HF2$$

Program will print these values to the screen

Program will print Lrpl to the screen

Program will calculate value for La where $$La=Lrpl+2*(\Delta wn) \text{ for } a=HF2+1 \text{ and } n=HF2$$

Program will print this value to the screen to the screen

Program will calculate values for Lb where $$Lb=La+2*(\Delta wn) \text{ for } b=HF2+2 \text{ to } b=HF \text{ and } n=HF2-1 \text{ to } n=1$$

Program will print these values to the screen

Step 5

Program will calculate; 2*π*[L1+αw2]

and designate this number; S

Program will designate Fnumber=S/αw3 and print Fnumber to the screen

Program will calculate Q=2*π*/{Fnumber(αw3+1)}

Program will calculate Yn; Yn=Ln*Q for n=2 to n=HF2

Program will print these values to the screen

Program will calculate Yrpl; Yrpl=Lrpl*Q

Program will print this value to the screen

Program will calculate Ya; Ya=La*Q where a=HF2+1

Program will print this value to the screen

Program will calculate Yn; Yn=Lb*Q and b=HF2+2 to b=HF

Program will print these values to the screen

Figure 29:
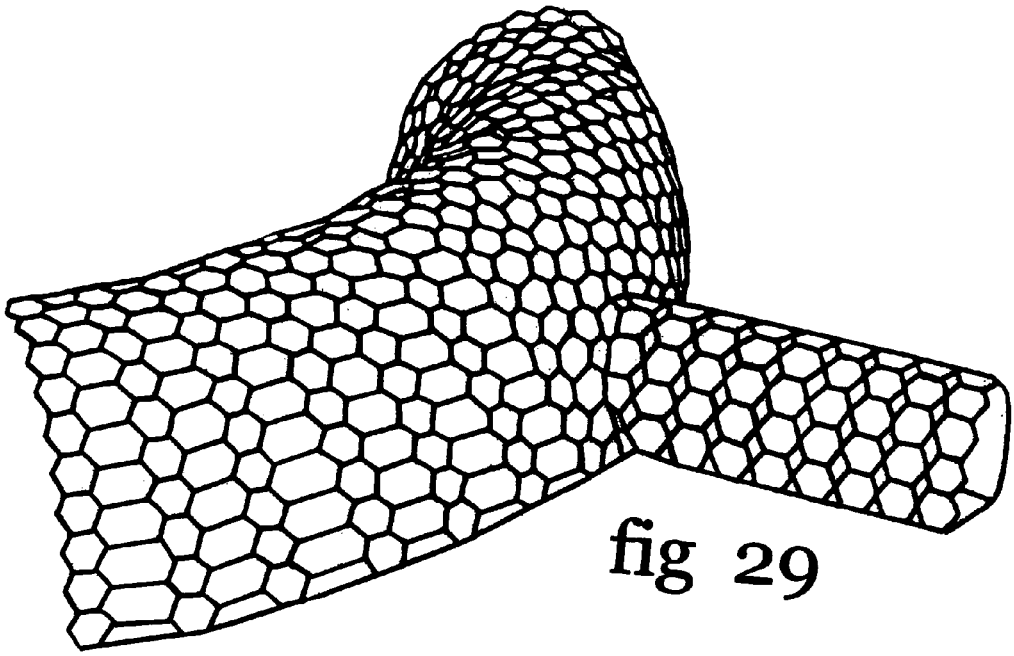
FIG. 29; view of straight tubular corridor joining into a circular tubular corridor FIG. 30; straight tubular corridor joining a ¾ Geodesic honeycomb sphere at one end and a circular tubular corridor at the other end FIG. 31; view showing inner and outer surfaces of a circular tubular corridor and joined to a straight tubular corridor which is joined to a ¾ sphere FIG. 32*a* & 32*b*; Explanation diagrams needed for Example 8
Figure 30:
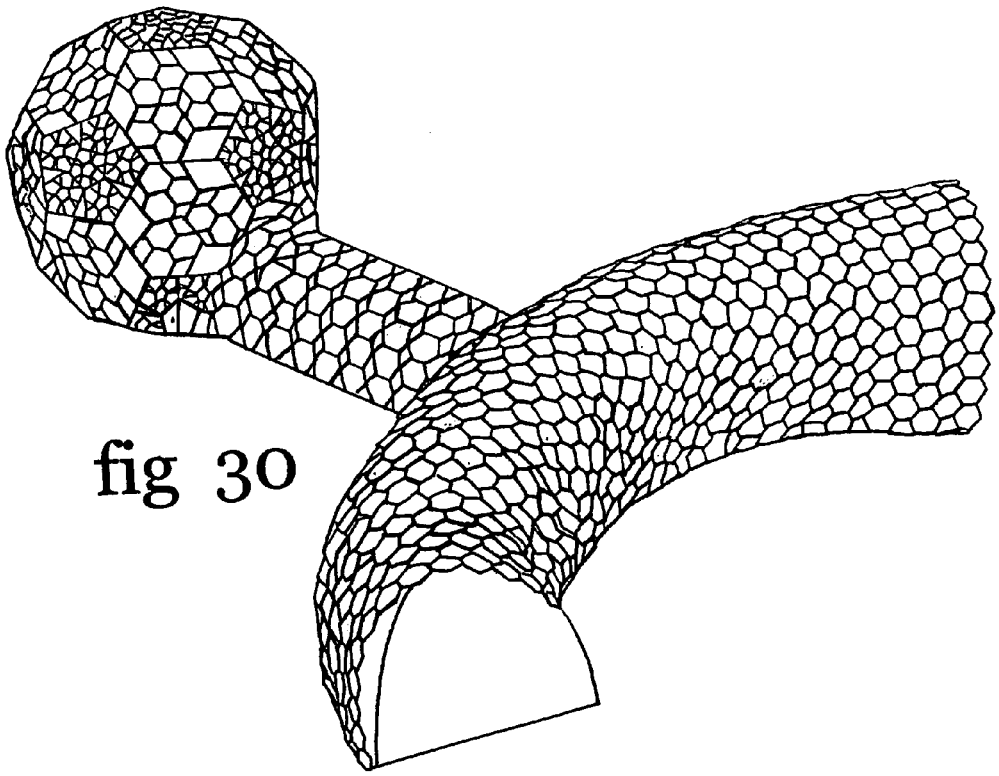

End of program d) Drawings of the tubular corridor connected to the honeycomb sphere are shown in FIGS. 29; 30 and 31

EXAMPLE 8

A straight tubular corridor is needed to be constructed using $2^{nd}$ lower level frustums (FIG. 19)

This section of straight tubular corridor should be approximately 3 metres in diameter and the length of the tubular corridor should be about 6 meters The minimal width of the lowest level hexagonal frustums is to be approximately 0.3 meters and the depth of the frustums should be approximately 0.15 meters.

a) Determine the angle of taper required on all sides of the hexagonal and polygon lowest level frustums to form a semi-circular arc of 3 metres diameter b) Determine the number of $2^{nd}$ lower level frustums that will form a semi-circular arc of the corridor. Determine the number of rows of frustums needed c) Produce a drawing of sections of the tubular connecting to a sphere. Produce a drawing of two ¾ spheres connected by the tubular corridors.

Solution a) The angle of taper required on the hexagonal frustums will be the same on both side surfaces 2 and 5

However the angle of taper required on side surfaces 1; 3; 4; 6 of the frustums will be different The formula for the angle of taper for spheres does not apply to tubular corridors. Instead the angle of taper will be determined by the constraints of the specified dimensions.

refer to FIGS. 27*a* and 27*b*; For a hexagon of side length t;

The minimal width is; t.√3

The maximal width is; 2.t

Figure 32A:
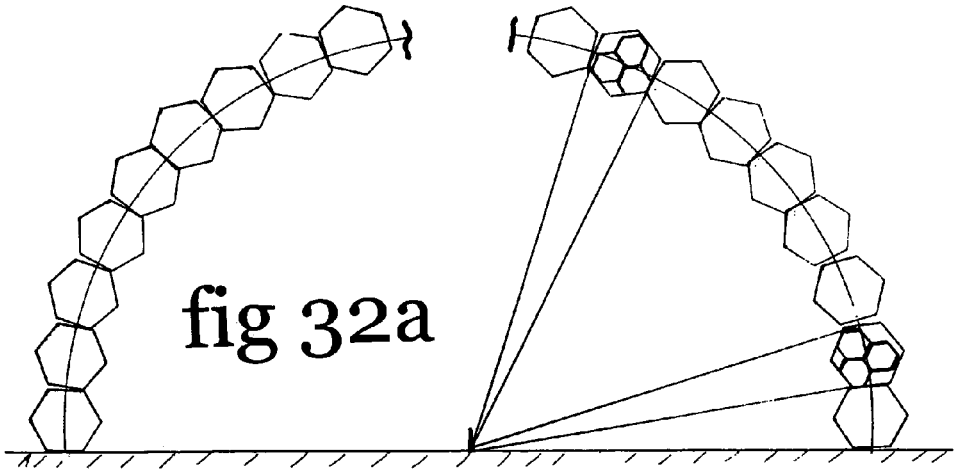
FIG. 32*c*; section of straight tubular corridor formed from $3^{rd}$ lower level pyramidal frustums joining into a ¾ geodesic honeycomb sphere FIG. 32*d*; Explanation diagram needed for ascertaining the tapering sides of the frustums for Example 8
Figure 32B:
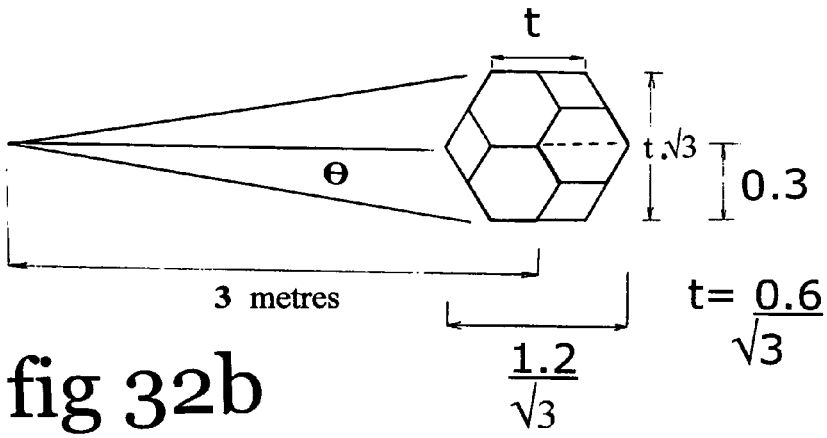

From FIG. 32*b*; t is the length of the sides of the $1^{st}$ level hexagonal frustums. The minimal width of the $2^{nd}$ lower level frustums =½(t.√3).

In this example it is specified that ½(t.√3)=0.3 meters thus t=0.6/√3 then 2t=1.2/√3=minimal width of $1^{st}$ level frustums

From FIG. 32*b;*

$$\theta=\arctan[\tfrac{1}{2}(t.\sqrt{3})/3]=\arctan(0.3/3)$$

θ=5.7 degrees which is the angle of taper required on sides 2 and 5 of the hexagonal frustums (using FIG. 28*e*)

In trying to ascertain the angle of taper required on side surfaces 1; 3; 4; 6 of the Frustums it might at first appear that no tapering angle is required on these side surfaces but this observation would be incorrect. Referring to FIG. 32*d* it would be true for a frustum with a square or rectangular base such as frustum Ψ. However, it is clearly recognizable that frustum Π requires tapering on side surfaces 1; 3; 4; 6

Frustum Φ will still require tapering for side surfaces 1; 3; 4; 6 although the angle of taper will be much less.

The angle of Taper on these side surfaces will be in linearly proportional to the degree of the tapering angle on side surfaces 2 and 5

For frustum Ω the required angle of taper on side surfaces 1; 3; 4; 6 will be;

$$\begin{aligned}\text{angle of taper} &= (\theta\Omega/90\text{ degrees})*(5.7\text{ degrees})\\ &= (30/90)*(5.7)\\ &= 1.9\text{ degrees}\end{aligned}$$

It is essential to note that a straight tubular corridor formed from frustums Ψ as shown in FIG. 32*d* will not require side surfaces 1; 2; 4; 6 to be tapering b) The diameter of the tubular corridor is to be 3 metres. Then the length of the semi-circular arc of the corridor will be;

$$\pi.D/2=4.7\text{ metres}$$

$$\text{Number of frustums required to form semi-circular arc must be an even number} = \frac{\text{length of semi-circular arc}}{\text{minimal width of frustums}} = 4.7/0.3\text{ meters} = 16\text{ approximately}$$

Figure 32C:
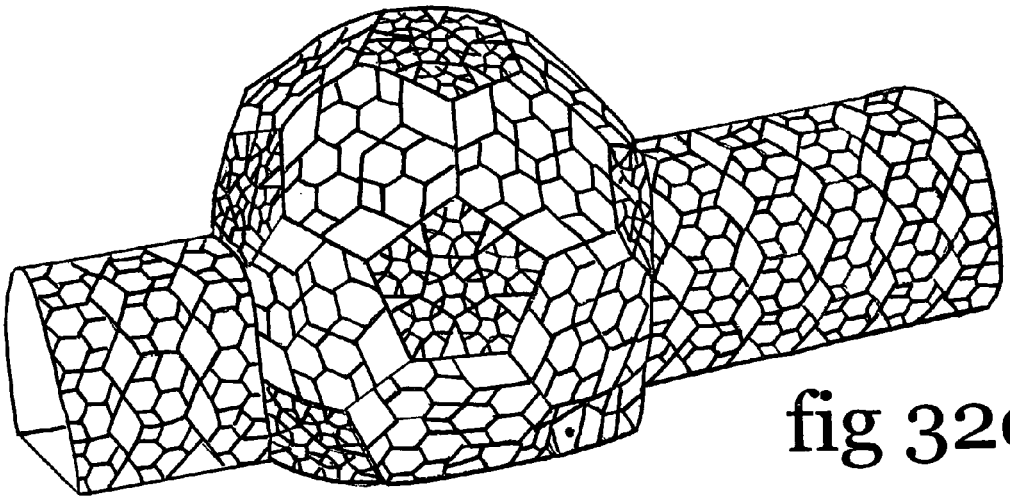
Figure 32D:
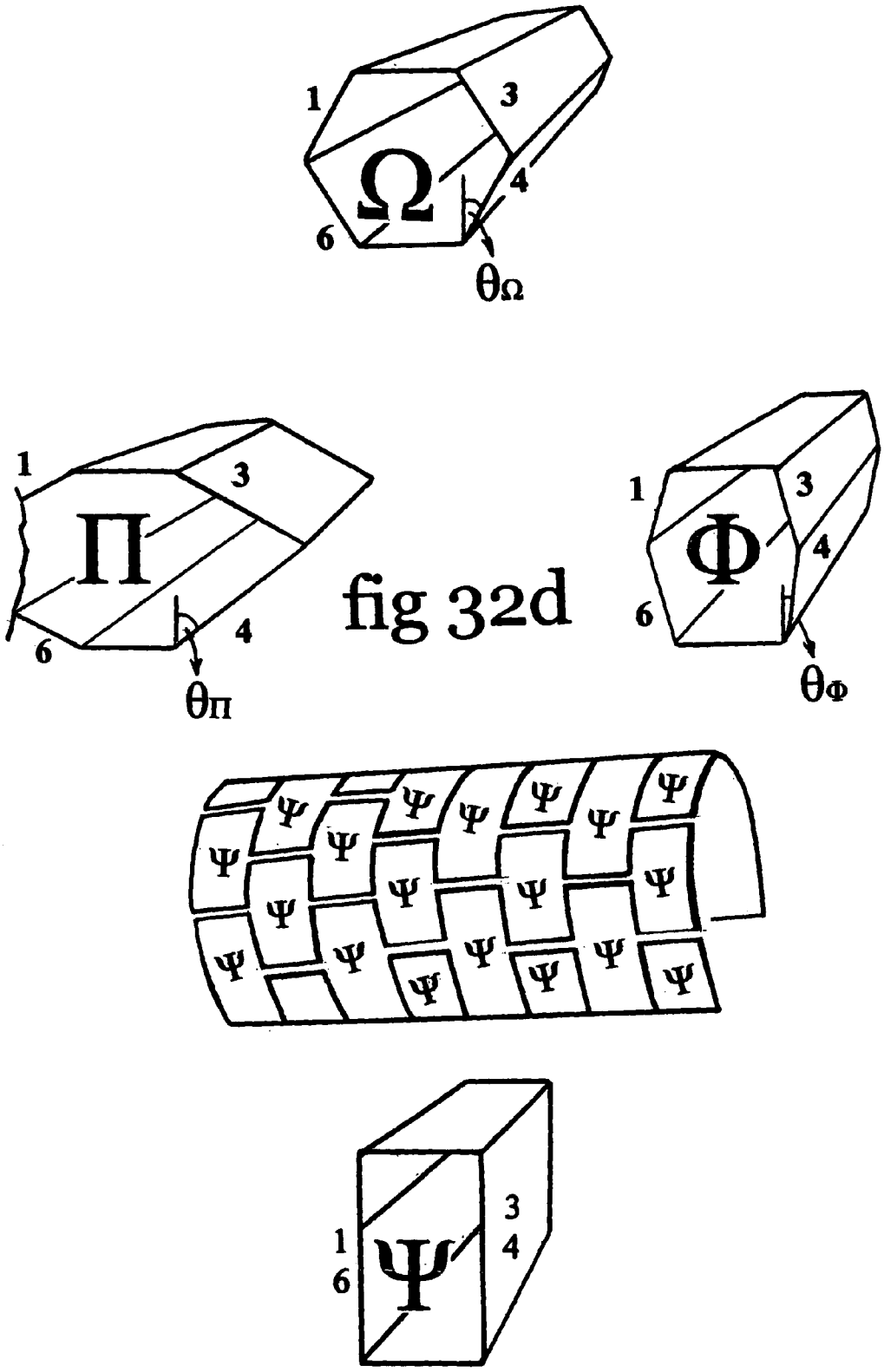
Figure 33:
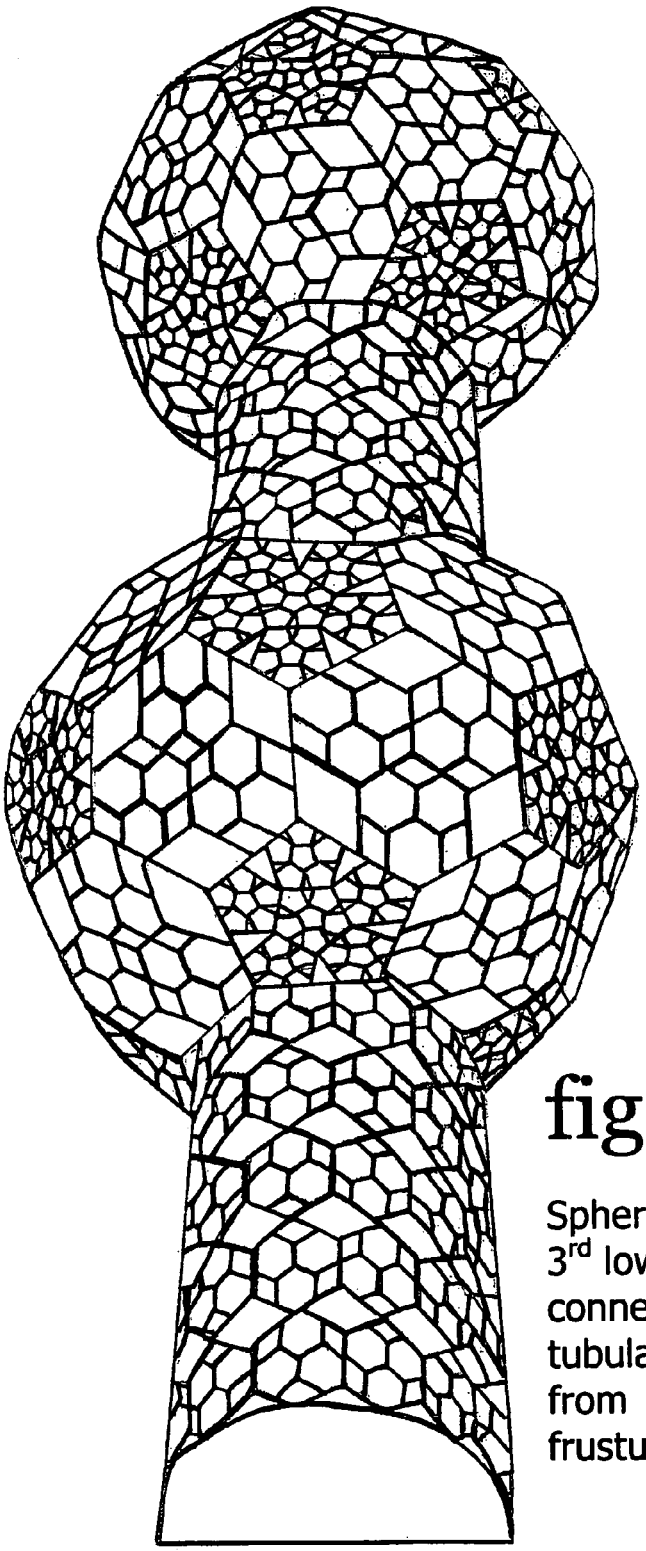
FIG. 33; view looking down upon two ¾ geodesic honeycomb spheres connected by a straight tubular corridor FIG. 34 and FIG. 35; Space Station constructed using the geodesic honeycomb skeleton
Figure 34:
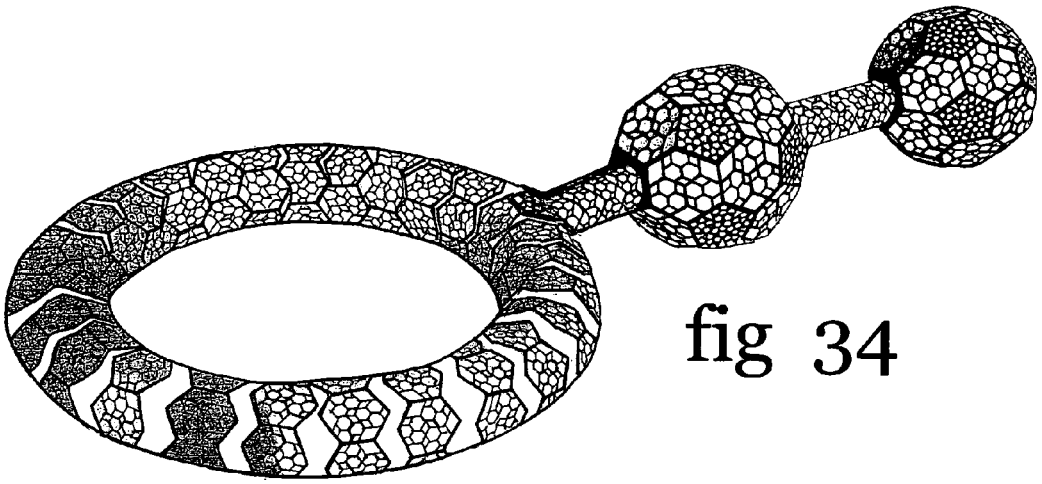
Figure 35:
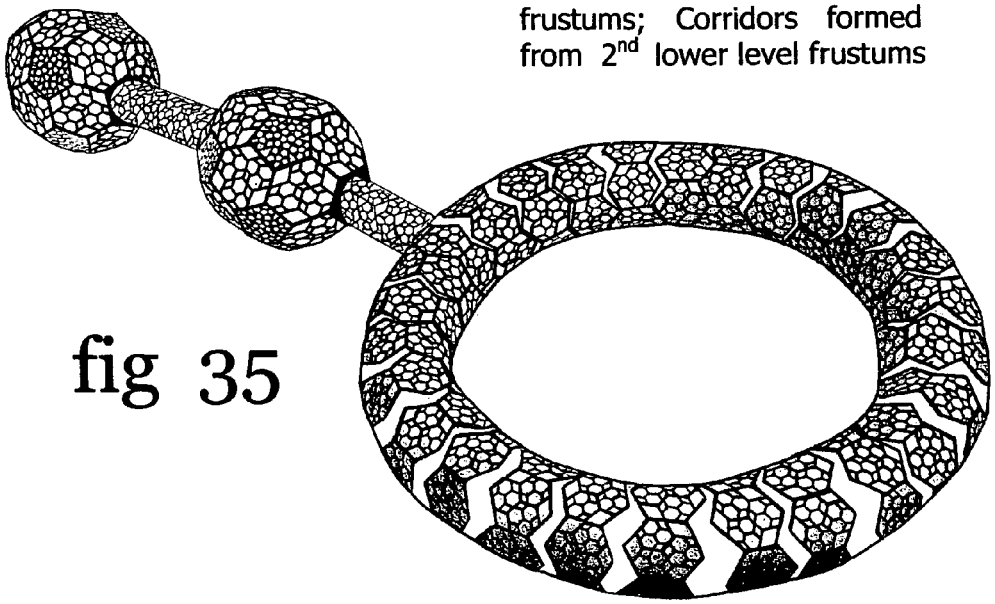

The number of rows of frustums needed for a 6 metre corridor will be;

$$\text{rows of frustums} = \frac{6\text{ meters}}{1.2/\sqrt{3}} = 9\text{ (approximately)}$$

c) Drawings are shown in FIGS. 32*c* and 33

EXAMPLE 9

A ¾ Geodesic Honeycomb Sphere formed from $2^{nd}$ lower level Aluminum alloy frustums was tested in a laboratory and found to resist an applied static force which is equivalent to the force of a 200 km/hour wind velocity. The rigidity modulus (elasticity of shear) for this Aluminum alloy is 24 gigapascals. The thickness of the Frustums is only 5 mm and the length of the frustums is only 100 mm. It is desired to construct a Geodesic Honeycomb sphere of the same diameter using the exact same size frustums but using a Nylon Acrylic that has similar mechanical properties as Aluminum. The rigidity modulus for this Nylon polymer material is 8.4 gigapascals. Determine the desired number of lower levels of frustums this new Geodesic Honeycomb sphere will need to be formed from if it is to resist the same wind velocity. Assume that for Aluminum τk=1;

For this nylon plastic τk will then likely be between 0 and 0.1.

Assume τk for the Nylon acrylic is (0.8)

Solution;

Recall that; $K_{nth\text{-}level}=(1/\tau cyl)*([C_{out}^2-C_{in}^2]\pi C_L)$ and that; $\tau cyl=(\tau k)(\tau)$ In this example the dimensions of the frustums will remain the same. The solution is now very simple because the ratio of the constant $K_{nth\text{-}level}$ for the Aluminum sphere and the Nylon sphere will be the same as the ratio of the lower levels of both spheres.

For the Aluminum sphere; τcyl=(1)*(24 gigaPascals)

Thus, let $K_{2nd\text{-}level}=1/24$

For the Nylon sphere; τcyl=(0.8)*(8.4 gigaPascals)

Thus, let $K_{nth\text{-}level}$=1/(0.8)(8.4)

$$\frac{1/24}{1/(0.8)(8.4)} = \frac{2}{n_{th} - \text{level}}$$

$$n_{th} - \text{level} = \frac{(24)(2)}{(0.8)(8.4)} = 7 \text{ approximately}$$

Thus, the Nylon Geodesic Honeycomb skeleton sphere should be formed from $7^{th}$ lower level frustums of the same dimensions to resist the same applied static force as the sphere formed from $2^{nd}$ lower level Aluminum Frustums.

OBSERVATION; The formula given above for the strength of the Geodesic Honeycomb Skeleton contains two constants; τk and $K_{nth\text{-}level}$. τk will be need to be evaluated by constructing spheres of different materials for the frustums but with all the dimensions of the frustums kept the same and all spheres constructed from the same number of lower levels. $K_{nth\text{-}level}$ could be evaluated by constructing spheres of varying lower levol formations but using the same material for the frustums, and with the same dimensions for the frustums. For each sphere, the applied static force required to deform the sphere is tabulated.

I claim:

1. A method of constructing spherical enclosures and tubular corridors providing the steps of:

a.) providing a plurality of hollow polygonal frustums including frustums that are hollow hexagonal frustums and hollow pentagonal frustums and hollow tri-angular frustums with dimensions chosen, assembling and fastening together the plurality of hollow polygonal frustums to form larger hexagonal and larger pentagonal frustums:

b.) repeating the above steps until a desired lower level of said hollow hexagonal and said hollow pentagonal frustums is obtained and where the individual frustums are cast such that each side surface of each hollow frustum forms a structural assemblage;

c) wherein said step of assembling and fastening said polygonal frustums produces a structural assemblage; said structural assemblage having two joining surfaces forming a flush join for the entire length and the entire width of each of the joining surfaces and where the said hollow frustums are fastened together using bolts that protrude through each flush joining side surface of each said hollow frustum in the network of flush joining surfaces and where such flush joining surfaces are made possible by an angle of taper of the outer side surfaces of said hollow frustums wherein said polygonal frustums of each structural assemblage are combined individually;

d) and wherein the polygonal frustums of said structural assemblage have the angle of taper which is the angle by which the side surfaces joining an inner base and an outer base of a frustum slant away from the plane perpindicular to a plane of the outer base of the hollow frustum whereby for a spherical enclosure or tubular corridor;

said angle of taper for said hollow hexagonal pyramidal frustum as a function of the level is $36/(2^{a})$ degrees, and whereby;

said angle of taper for said hollow pentagonal pyramidal frustum as a function of the level is $36/(3^{a-1})^{*}(2)$ degrees;

where a is the level and;

where the term level relates to the process of frequency subdivision of a polyhedron such that the so formed level of the spherical enclosure or tubular corridor refers to and is determined by the number of smaller hollow frustums contained within a boundary of a largest hexagonal or pentagonal frustum in the spherical enclosure or tubular corridor where a lower level formation of the Geodesic skeleton signifies a higher frequency subdivision of the largest frustums and where the terms desired level or desired lower level refer to and form part of the design selection criteria and are determined by;

(i) the material of which the hollow frustums are made from;

(ii) the dimensions of the largest level hollow pyramidal frustums; and (iii) the anticipated wind velocities impacting upon the structure to tear the structure apart ;

where the resulting assemblage of said hollow polygonal frustums are defined as a Geodesic Honeycomb Skeleton.

* * * * *